US006036510A

United States Patent [19]

Ono et al.

[11] Patent Number: 6,036,510

[45] Date of Patent: Mar. 14, 2000

[54] CONNECTOR CONNECTING STRUCTURE

[75] Inventors: Junichi Ono; Kensaku Takata; Souji Kihira, all of Nagoya, Japan

[73] Assignees: Harness System Technologies Research, Ltd., Nagoya; Sumitomo Wiring Systems, Ltd., Mie; Sumitomo Electric Industries, Ltd., Osaka, all of Japan

[21] Appl. No.: 09/299,750

[22] Filed: Apr. 27, 1999

Related U.S. Application Data

[62] Division of application No. 08/826,736, Apr. 4, 1997, Pat. No. 5,921,791.

[30] Foreign Application Priority Data

Apr. 9, 1996 [JP] Japan ..... 8-086804
Apr. 26, 1996 [JP] Japan ..... 8-107997

[51] Int. Cl.[7] ..... H01R 13/62

[52] U.S. Cl. ..... 439/157; 439/152; 439/153

[58] Field of Search ..... 439/157, 152, 439/160, 310, 153, 155

[56] References Cited

U.S. PATENT DOCUMENTS

| | | | |
|---|---|---|---|
| 5,110,301 | 5/1992 | Inoue et al. | 439/310 |
| 5,244,400 | 9/1993 | Hatagishi | 439/157 |
| 5,322,448 | 6/1994 | Hahn | 439/157 |
| 5,391,086 | 2/1995 | Woller et al. | 439/157 |
| 5,496,186 | 3/1996 | Dobbelaere et al. | 439/157 |
| 5,618,195 | 4/1997 | Cappe | 439/157 |
| 5,954,528 | 9/1999 | Ono et al. | 439/157 |

FOREIGN PATENT DOCUMENTS

| | | |
|---|---|---|
| 501502 | 9/1992 | European Pat. Off. . |
| 9415639 U | 12/1994 | Germany . |
| 3-194871 | 8/1991 | Japan . |
| 3-126379 | 12/1991 | Japan . |
| 4-319271 | 11/1992 | Japan . |
| 2-239566 | 7/1991 | United Kingdom . |

*Primary Examiner*—Paula Bradley
*Assistant Examiner*—Tho D. Ta
*Attorney, Agent, or Firm*—Oliff & Berridge, PLC

[57] ABSTRACT

A connector connecting structure, includes a first connector supported by a holder and a second connector to be connected to the first connector. In the connector connecting structure, there is provided in the holder a support portion including a recessed groove or the like for supporting the first connector in such a manner that the first connector can be slid in a direction where the two connectors can be connected together, while two slide members slidable and displaceable in a direction at right angles to the connecting direction of the two connectors are respectively supported between the holder and first connector. In the structure, there are further provided a drive part which, according to the sliding displacement of the first connector, drives the two slide members so that they can be slid and displaced, and an operation part which can increase the drive force of the slide members and can transmit the thus increased drive force to the connecting portions of the first and second connectors, thereby being able to drive the two connectors in the connecting direction thereof.

5 Claims, 10 Drawing Sheets

CONNECTOR CONNECTING STRUCTURE

This is a Division of application Ser. No. 08/826,736 filed Apr. 4, 1997, U.S. Pat. No. 5,921,791. The entire disclosure of the prior application(s) is hereby incorporated by reference herein in its entirety.

BACKGROUND OF THE INVENTION

The present invention relates to a connector connecting structure which connects mutually corresponding male and female connectors to each other to thereby allow them to be in electric conduction with each other.

Conventionally, for example, as disclosed in Unexamined Japanese Patent Publication No. 4-319271, in order to enhance the connected condition of a connector of a multi-polar structure having a large number of terminals and a large connecting resistance, there is known an electric connector of a slide connecting type. In particular, the conventional electric connector includes a holder (a slide member) which is used to hold a first connector inserted therein and includes a plurality of engaging projections formed in the upper and lower wall surfaces thereof, a second connector which is formed in a substantially rectangular shape and includes not only a recessed portion into which the holder can be inserted but also an opening formed in the side wall thereof substantially in parallel to the side wall, and a substantially U-shaped operation member including a cam grooves which is engageable with the engaging projections of the holder, wherein the first and second connectors can be connected to each other by sliding the operation member.

Referring further to the structure of the above-mentioned conventional electric connector of a sliding connection type, after the first connector is inserted into and held by the holder, a plate-shaped portion of the operation member is inserted into the opening formed in the side wall of the second connector, the engaging projections of the holder holding the first connector inserted therein are matched in position to the cam groove of the operation member and are then engaged therewith, and, in such engaged condition, the operation member is pushed in the longitudinal direction of the holder to thereby slide the engaging projections of the holder along the cam groove of the operation member, so that the first connector held by the holder can be connected to the second connector.

In the above-mentioned conventional structure, the second connector engaged with the operation member is provisionally engaged with the first connector held by the holder, and the engaging projections formed in the holder are matched in position to the cam groove formed in the operation member. After then, by pushing the operation member in the longitudinal direction of the holder, the first connector must be connected to the second connector. That is, in this structure, the connecting operation must be executed at two or more stages, which is troublesome.

Especially, when one of the two connectors is mounted on the leading end portion side of an electronic unit such as a meter unit, an air conditioning unit or the like to be mounted on an instrumental panel of a vehicle, once the electronic unit is assembled into the instrumental panel, the operation portion of the operation member cannot be driven and, therefore, the electronic unit must be assembled into the instrumental panel after the above connector is connected to the other connector, which results in the very troublesome assembling operation.

Also, after the connector connecting operation is completed, since the plate-shaped portion of the operation member is inserted into the second connector, the width dimension of the connector can be reduced. However, before the connector connecting operation is executed, because the operation member projects out laterally of the connector to a great extent, it is necessary to secure a space for operation of the operation member, which raises a problem that a large dead space is inevitably produced.

Furthermore, for example, as disclosed in Unexamined Japanese Patent Publication No. 3-194871, in order to enhance the connected condition of a connector of a multi-polar structure which includes a large number of terminals and shows a large connecting resistance, there is known a multi-polar connector of a low insertion force type in which, in one connector, a pinion is rotatably supported and a slide rack piece member to be engaged with the pinion is slidably supported, and, in the other connector, there is provided a fixing rack portion to be engaged with the pinion of one connector, whereby, if the slide rack piece member is operated or slid to thereby drive or rotate the pinion, then the two connectors can be connected to each other.

That is, the above-mentioned conventional low insertion force multi-polar connector is structured such that a male connector housing forming one connector is provisionally fitted with a female connector housing forming the other connector to thereby bring the pinion supported in the male connector housing into meshing engagement with the front portion of the fixing rack portion formed in the female connector housing and, after then, if an operator pushes in the slide rack piece member supported in the male connector housing by his or her finger to thereby cause the same to slide, then the slide rack piece member is allowed to roll on the fixing rack portion while the pinion is being rotated, thereby applying a forwardly advancing force to the pinion, so that the two connectors can be connected together.

In the conventional connector having the above-mentioned structure, since the two connectors can be connected together by pushing the slide rack piece member in the same direction as the connecting direction of the two connectors, the connecting operation can be carried out comparatively easily. However, after the connector housings of the two connectors are provisionally fitted with each other, it is necessary to fit the male and female connector housings with each other by pushing the slide rack piece member. That is, this connecting operation must be executed in at least two stages.

In particular, when one of the two connectors is mounted on the leading end portion side of an electronic unit such as a meter unit, an air conditioning unit or other similar units to be assembled to the instrumental panel of a vehicle, once the electronic unit is assembled to the instrumental panel, the operation portion of the slide rack piece member cannot be driven any longer. For this reason, the electronic unit must be assembled to the instrumental panel after the two connectors are connected together, which results in the troublesome assembling operation.

Also, after the connecting operation of the two connectors is completed, since most of the slide rack piece member are inserted into the female connector housing, the installation space for the connector can be reduced. However, before the connector connecting operation is carried out, the pushing operation portion of the slide rack piece member is projected out backwardly of the connector, which makes it necessary to secure an operation space for operation of the slide rack piece member. That is, a dead space is inevitably produced.

SUMMARY OF THE INVENTION

The present invention aims at eliminating the drawbacks found in the above-mentioned conventional connector connecting structure. Accordingly, it is an object of the invention to provide a connector connecting structure which is able to connect a pair of connectors to each other positively by a simple operation and is also able to reduce a connector installation space.

In attaining the above object, according to the first aspect of the invention, there is provided a connector connecting structure comprising a first connector supported by a holder and a second connector to be connected to the first connector, wherein there is provided in the holder a support portion for supporting the first connector in such a manner that the first connector can be slid in the connecting direction of the first and second connectors, and a slide member slidingly displaceable in a direction at right angles to the connecting direction of the two connectors is supported between the holder and the first connector, and also wherein there are further provided a drive part for sliding and displacing the slide member according to the sliding displacement of the first connector, and an operation part for increasing the drive force of the slide member and transmitting the thus increased drive force to the connecting portions of the first and second connectors to thereby be able to drive the two connectors in the connecting direction thereof.

According to the above-mentioned structure, if the first connector is slid and displaced along the holder according to the operation force for connecting the first and second connectors, then the slide member is slid and displaced according to the drive force input therein from the drive part, and the drive force is increased and transmitted from the operation part to the connecting portion of the two connectors, so that a great connecting force can be applied to the two connectors.

Further, according to the invention, a plate-shaped slide member is interposed between the inner wall surface of the holder and the outer wall surface of the first connector.

According to the above-mentioned structure, since a plate-shaped slide member having a small thickness is interposed between the holder and first plate, the installation space of the slide member can be controlled down to a small space, which makes it possible to reduce the size of the connector.

Further, according to the invention, a pair of slide members are respectively so provided as to extend along the mutually opposed wall surfaces of the holder, and the two slide members are arranged at point symmetrical positions to each other.

According to the above-mentioned structure, if the first connector is slid and displaced along the holder according to the drive force for connecting together the first and second connectors, then a great connecting force can be applied from the two slide members to the two diagonally positioned end portions of the two connectors.

Still further, according to the invention, in the connecting portion of the holder and first connector, there is provided a removal prevention portion which is used to prevent the first connector from being pulled out forwardly from the holder.

According to the above-mentioned structure, provision of the removal prevention portion prevents the possibility that the first connector inserted into the holder can be pulled out from the holder and the connected condition between the holder and first connector can be thereby removed.

Yet further, according to the invention, in the connecting portion of the holder and first connector, there is provided a provisionally securing portion which is used to secure the first connector at a connection wait position provisionally, and the provisionally secured condition of the first connector by the provisionally securing portion can be removed according to the operation force for connecting the first and second connectors to each other.

According to the above-mentioned structure, before the two connectors are connected together, the first connector can be provisionally secured at the connection wait position by the provisionally securing portion and, in the two connectors connecting operation, the provisionally secured condition of the first connector by the provisionally securing portion can be removed and thus the first connector can be slid and displaced along the holder.

In attaining the above object, according to the second aspect of the invention, there is provided a connector connecting structure comprising a first connector supported slidably by a holder and a second connector to be connected to the first connector, wherein a swingable member including a pinion portion in the leading end portion thereof is swingably supported between the holder and first connector, there is provided in the connector a rack portion meshingly engageable with the pinion portion of the swingable member, there is provided a drive part which, in an operation to connect the second connector to the first connector, can swing and displace the swingable member according to the sliding motion of the first connector to thereby drive the pinion portion in a direction where the second connector is moved toward the first connector, and a distance from the drive part to the swing support point of the swingable member is set larger than a distance from the pinion portion of the swingable member to the swing support point of the swingable member.

According to the above-mentioned structure, if the first connector is slid along the holder according to an operation force for connecting the first and second connectors to each other, then the swingable member is driven by the drive part and is thereby swung and displaced and, at the same time, the drive force of the swingable member is increased according to the principles of leverage and the thus increased drive force is then transmitted from the pinion portion of the swingable member to the rack portion of the second connector in meshing engagement with the pinion portion of the swingable member, so that the second connector can be driven or moved toward the first connector with a great force.

Also, according to the invention, a plate-shaped swingable member is interposed between the wall surface of the holder and the wall surface of the first connector that is opposed to the present holder wall surface.

According to the above-mentioned structure, since a swingable member having a small plate thickness is interposed between the holder and first connector, an installation space necessary for installation of this swingable member can be reduced down to a small space, which makes it possible to supply a compact connector.

Further, according to the invention, a pair of swingable members are respectively installed along the mutually opposed wall surfaces of the holder, and the two swingable members are arranged at positions symmetrical to each other with respect to a point.

According to the above-mentioned structure, if the first connector is slid along the holder according to a drive force for connecting the first and second connectors to each other, then a great connecting force can be applied from the two swingable members to the two end portions of the two connectors on the diagonal lines thereof.

According to the invention, in the connecting portion of the holder and first connector, there is provided a removal prevention portion which is used to prevent the first connector from being pulled out forwardly from the holder.

According to the above-mentioned structure, the removal prevention portion eliminates the possibility that the first connector supported within the holder can be pulled out from the holder to thereby remove the connected condition between the holder and first connector.

According to the invention, in the connecting portion of the holder and first connector, there is provided a provisionally securing portion which secures the first connector provisionally at a connection wait position, and the provisionally secured condition of the first connector by the provisionally securing portion can be removed according to an operation-force for connecting the first and second connectors to each other.

According to the above-mentioned structure, before the two connectors are connected together, the first connector is provisionally secured at the connection wait position by the provisionally securing portion and, in the connecting operation of the two connectors, the provisionally secured condition of the first connector by the provisionally securing portion can be removed automatically so that the first connector can be slid along the holder.

DETAILED DESCRIPTION OF THE PREFERRED EMBODIMENTS

First Embodiment

Figure 1:
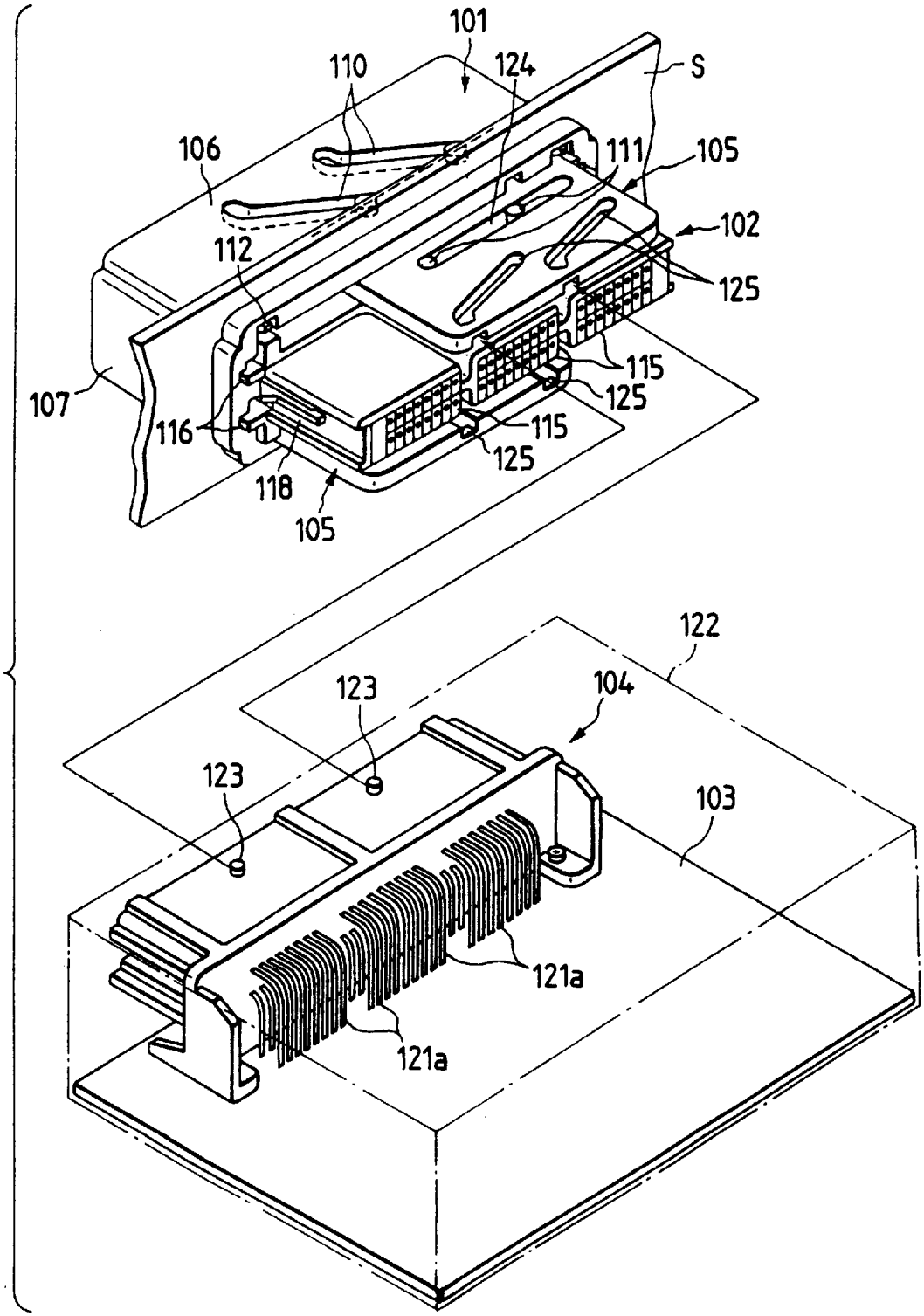
FIG. 1 is a perspective view of first embodiment of a connector connecting structure according to the invention.

Now, FIG. 1 shows a first embodiment of a connector connecting structure according to the invention. The present connector comprises a holder 101 mounted on a mounting portion S which consists of a stay member or the like provided in a vehicle, a first connector 102 supported slidably by the holder 101, a second connector 104 mounted on a circuit board 103 which forms an electronic unit 122, and a pair of slide members 105 which are respectively used to drive the second connector 104 in a direction where the second connector 104 can be connected to the first connector 102.

Figure 2:
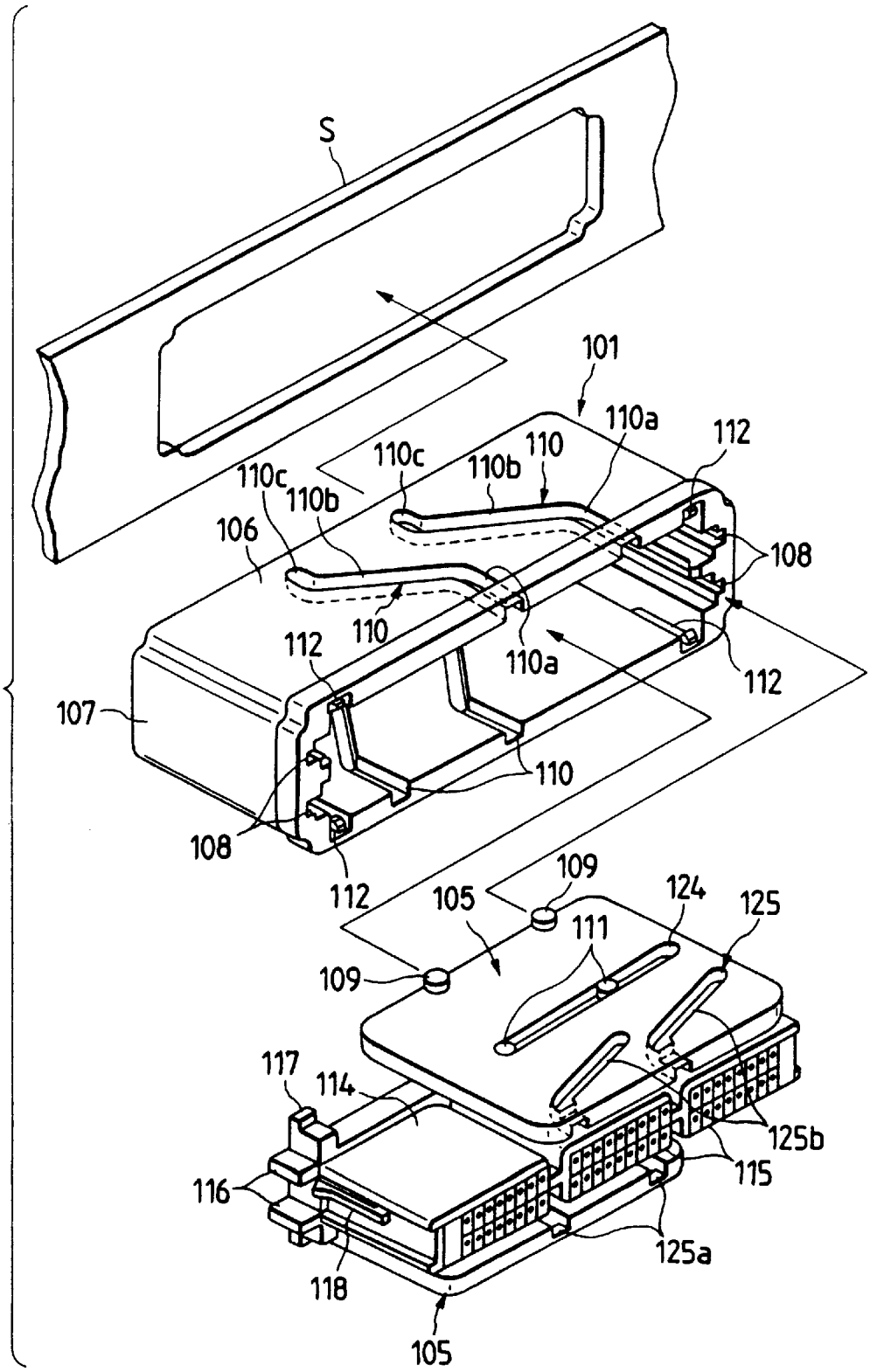
FIG. 2 is an exploded perspective view of a concrete structure of a first connector employed in the embodiment.

The holder 101, as shown in FIG. 2, is formed in a tubular shape which includes a pair of top and bottom horizontal plates 106 and a pair of right and left side plates 107, while the holder 101 can be fitted into a mounting hole formed in the mounting portion S of the vehicle body and can be fixed thereto by a screw or similar fixing means. And, in the respective wall surfaces of the two right and left side plates 107 of the holder 101, there are formed support portions which respectively extend in the horizontal direction thereof and respectively consist of a pair of upper and lower recessed grooves 108 used to support the first connector 102 in a such a manner that it can be freely slid.

Each of the slide members 105 includes a pair of engaging pins 109 which are respectively provided on and projected from the upper surface of the rear end portion of the slide member 105. In the horizontal plate 106, there are formed a pair of guide grooves 110 which are arranged in parallel to each other. The two engaging pins 109 can be engaged with the two guide grooves 110, respectively. Each of the guide grooves 110 includes an introduction portion 110*a* extending backwardly from the front end portion of the holder 101, a drive groove portion 110*b* backwardly and inwardly from the rear portion of the introduction portion 110*a*, and a securing portion 110*c* extending backwardly from the end portion of the drive groove portion 110*b*. In the present embodiment, the drive groove portion 110*b* is formed such that it extends backwardly and inwardly of the rear portion of the holder 101 in a straight line. However, the drive groove portion may also be formed such that it extends backwardly and inwardly from the end portion of the introduction portion 110*a* in a curved line.

Also, the guide groove 110 formed in the upper horizontal plate 106 is symmetrical to the guide groove 110 formed in the lower horizontal plate 106. That is, in the present embodiment, when viewed from the front surface side of the holder 101, a pair of guide grooves 110 are formed in parallel to each other on the right side of the upper horizontal plate 106, while a pair of guide grooves 110 are formed in parallel to each other on the left side of the lower horizontal plate 106.

Figure 3:
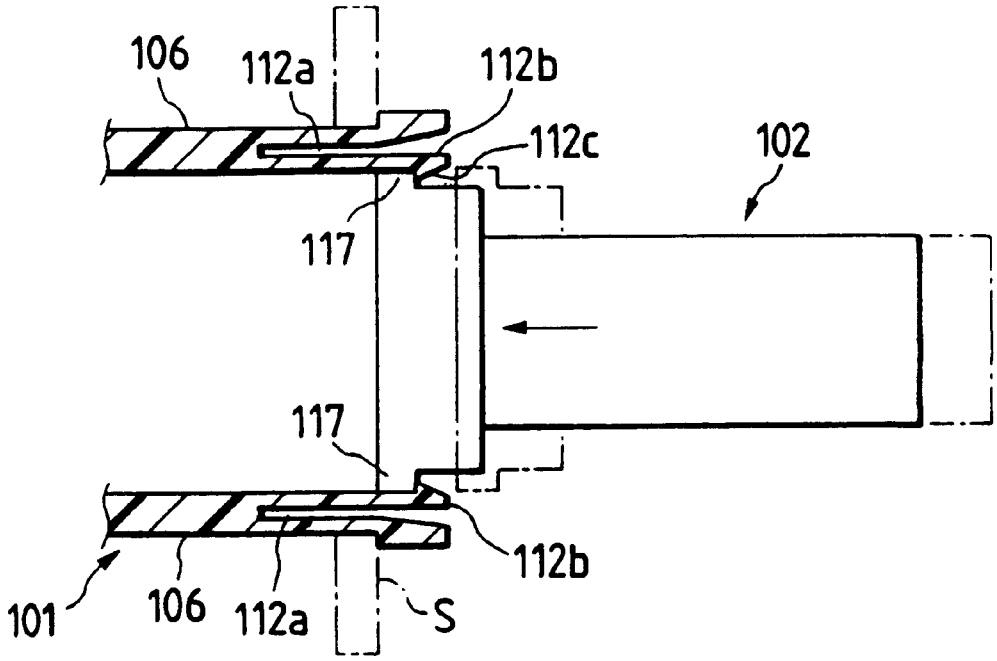
FIG. 3 is a sectional side view of the first embodiment, showing a state in which the first connector is secured by removal prevention portions.

The horizontal plates 106 of the holder 101, as shown in FIG. 3, include slits 112*a* which are respectively formed on the right and left portions of the inner wall surfaces of the horizontal plates 106 and also which respectively have a given width. Due to provision of the slits 112*a*, there is provided a removal prevention portion 112 which secures the first connector 102 at its forward wait position, while the removal prevention portion 112 includes in the leading end portion thereof securing stepped portions 112*b* which are respectively opposed to projecting portions 117 formed in the rear portion of the first connector 102. And, in operation, the front surfaces of the projecting portions 117 are contacted with the rear surfaces of the securing stepped portions 112*b* to thereby be able to prevent the first connector from being removed forwardly from the holder. Also, each of the securing stepped portions 112*b* includes a tapered surface on the outer surface of the leading end portion thereof, so that the securing stepped portion 112*b* has a forwardly tapered shape.

The first connector 102 includes a male-type connector housing 114 which can be inserted into the holder 101 and can be supported slidably therein, and a plurality of female-type terminals which are disposed within a terminal storage chamber formed in the connector housing 114. The connector housing 114 includes a pair of upper and lower projecting portions 116 which are respectively formed on the right and left side surfaces of the rear end portion of the connector housing 114 in such a manner that they can be slid along the recessed grooves 108 of the holder 101. Also, the connector housing 114 further includes projecting portions 117 which are provided on the right and left sides of the upper and lower surfaces of the rear end portion thereof in such a manner that they can be secured to the securing stepped portions 112*b* of the removal prevention portion 112.

Figure 4:
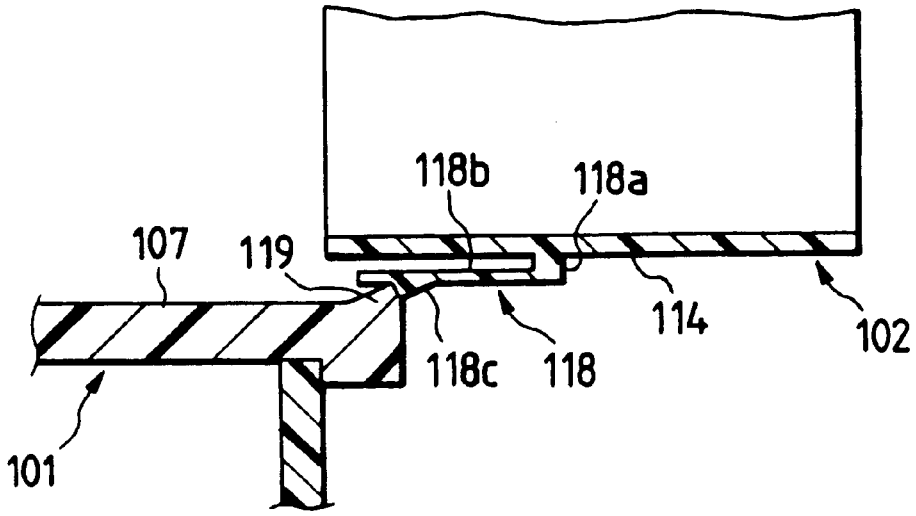
FIG. 4 is a sectional plan view of the first embodiment, showing a state in which the first connector is secured at a connection wait position provisionally.

Also, on the right and left side surfaces of the connector housing 114, as shown in FIG. 4, there are formed provisionally securing portions 118 which are used to secure the first connector 102 provisionally at the above-mentioned connection wait position to thereby prevent the first connector 102 from being pushed into the holder 101 before the execution of a connectors connecting operation to be described later. Each of the provisionally securing portions 118 includes a base end portion 118*a* projectingly provided on the side wall surface of the connector housing 114, a plate-shaped portion 118*b* which extends backwardly while it is opposed to the side wall surface of the connector housing 114 with a given clearance between them, and a projecting portion 118*c* which is projectingly provided on the outer surface of the rear portion of the plate-shaped portion 118*b*.

The projecting portion 118*c* of the provisionally securing portion 118, when viewed from a plane thereof, is so formed as to have a triangular shape and, on the outer side surface thereof, there are formed a pair of tapered surfaces. Also, on the front surface of the holder 101, there is provided a projection 119 including a pair of tapered surfaces corresponding to the tapered surfaces of the projecting portion 118*c*. And, in operation, the rear tapered surface of the projecting portion 118*c* provided in the provisionally securing portion 118 is contacted with the front tapered surface of the projection 119 provided on the holder 101 to thereby be able to secure the first connector 102 provisionally at the connection wait position.

Figure 5:
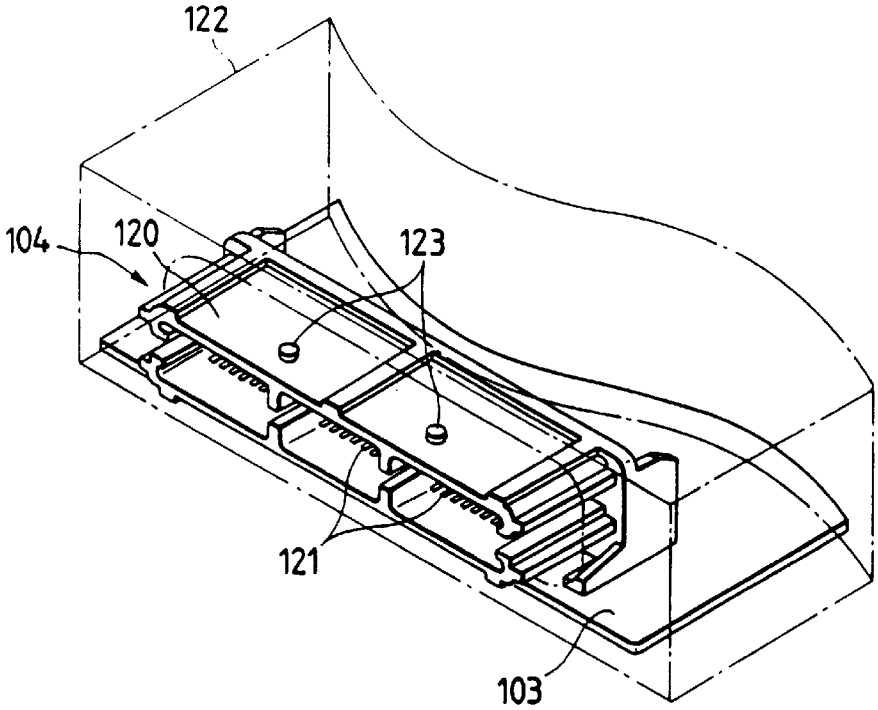
FIG. 5 is a perspective view of a concrete structure of a second connector employed in the first embodiment.

The second connector 104, as shown in FIG. 5, includes a female-type connector housing 120 which can be fitted over and engaged with the connector housing 114 of the first connector 102, and a plurality of male-type terminals 121 disposed within a terminal storage chamber formed in the connector housing 120. The connector housing 120 is fixed onto the circuit board 103 by screwing or by other similar fixing means, while the connecting portions 121*a* of the male-type terminals 121 are respectively guided out from the rear end portion of the connector housing 120 and are connected to the introduction portion of the circuit board 103 by soldering or by other similar connecting means (see FIG. 1).

Also, the second connector 104 and circuit board 103 are respectively stored within a case for an electronic unit 122. The connector housing 120 further includes on the outer surface thereof a pair of driven pins 123 which can be driven by the slide member 105, while the driven pins 123 are projectingly provided at a position opposed to the installation position of the slide member 105.

Figure 6:
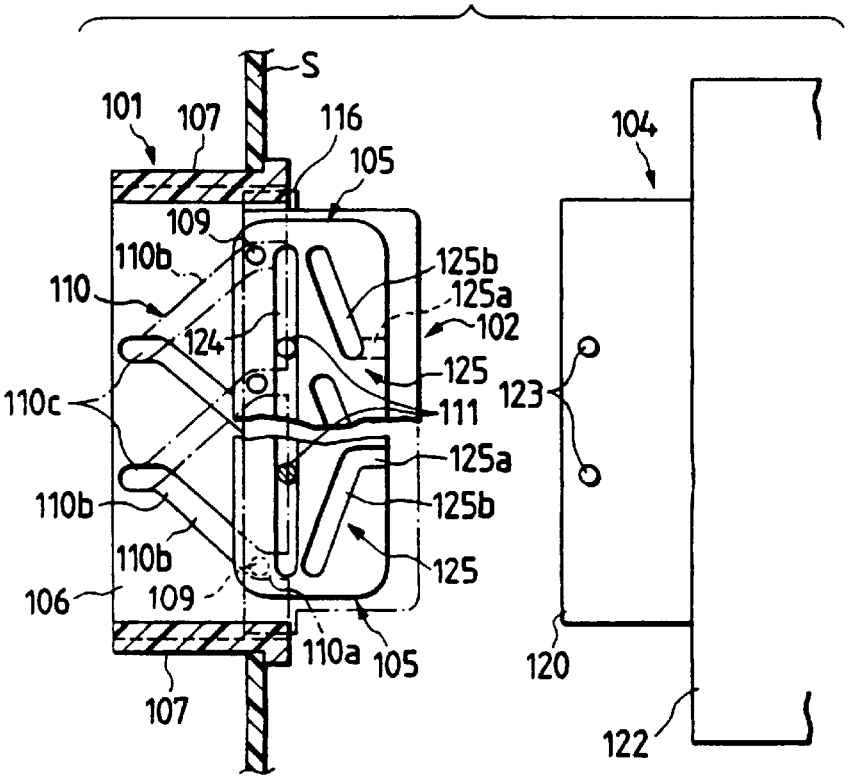
FIG. 6 is a sectional plan view of the first embodiment, showing a state thereof before the first and second connectors are connected to each other.

The above-mentioned slide members 105 are respectively formed of plate members interposed between the inner wall surfaces of the holder 101, which are composed of the lower surface of the upper horizontal plate 106 and the upper surface of the lower horizontal plate 106 respectively forming the holder 101, and the outer wall surfaces of the first connector 102 which are composed of the upper and lower surfaces of the connector housing 114. Also, as shown in FIGS. 2 and 6, each of the slide members 105 is slidably supported by a pair of connecting pins 111 projectingly. provided on the connector housing 114 of the first connector 102 at a position which is opposed to the guide groove 110 formed in the holder 101.

That is, in the slide member 105, there is formed a guide groove 124 which extends laterally (longitudinally) of the holder 101 and first connector 102 and, thus, if the pair of connecting pins 111 are fitted into the present guide groove 124, then the slide member 105 is supported in such a manner that not only the oscillating displacement of the slide member 105 can be restricted by the two connecting pins 111 but also the slide member 105 is allowed to be slid and displaced in a direction at right angles to the connecting direction of the two connectors 102 and 104 within the range of formation of the guide groove 124. Here, it should be noted that the slidingly displacing direction of the slide member 105 is not always limited to the above direction that extends exactly at right angles to the connecting direction of the two connectors 102 and 104.

Also, on the outer surfaces of the respective rear end portions of the upper and lower slide members 105, that is, on the upper surface of the rear end portion of the upper slide member 105 and on the lower surface of the rear end portion of the lower slide member 105, there are respectively provided engaging pins 109 which can be fitted into the guide grooves 110 respectively. At the same time, on the portion of the slide member 105 that is situated forwardly of the guide groove 124, there are formed a pair of engaging grooves 125 into which two driven pins 123 can be fitted respectively, while the two driven pins 123 are projectingly provided on the upper and lower portions of the connector housing 120 of the second connector 104.

Each of the two engaging grooves 125 of the slide member 105 is composed of an opening portion 125*a*, which serves as an introduction and guide portion for its corresponding driven pin 123, and an operation groove portion 125*b* which continues with the opening portion 125*a* and extends outwardly of the rear portion of the slide member 105. The operation groove portion 125*b* is formed such that the width direction dimension thereof is set substantially the same as the width dimension of the drive groove portion 110*b* of the holder 101 and the longitudinal direction dimension thereof is set for a value smaller than the value of the longitudinal direction dimension of the drive groove portion 110*b* of the holder 101, whereby the directions of inclination of the operation groove portion 125*b* and drive groove portion 110*b* are set such that the angle of inclination of the operation groove portion 125*b* with respect to the width direction of the connector is smaller than the angle of inclination of the drive groove portion 110*b* formed in the holder 101.

As described above, since the direction of inclination of the operation groove portion 125*a* formed in the slide member 105 is set opposite to the direction of inclination of the drive groove portion 110*b* formed in the holder 101, when the two connectors 102 and 104 are connected together, as the first connector 102 is pushed into the holder 101, the slide members 105 are slid and displaced (which will be discussed later) to thereby transmit a drive force from the engaging grooves 125 of the slide member 105 to the driven pins 123, so that the second connector 104 can be driven or drawn toward the first connector 102.

Also, since the directions of inclination of the operation groove portions 125*b* and drive groove portions 110*b* are set such that the angle of inclination of the operation groove portions 125*b* with respect to the width direction of the connector is smaller than the angle of inclination of the drive groove portions 110*b* formed in the holder 101, the amount of movement of the second connector 104 in the above-mentioned connecting direction is smaller than the amount of movement of the first connector 102 when it is pushed into the holder 101 according to the connecting operation force for connecting together the two connectors 102 and 104, with the result that the drive force transmitted from the drive groove portions 110*b* to the slide members 105 can be increased before it is transmitted to the second connector 104.

That is, the drive groove portions 110*b* of the guide grooves 110 respectively formed in the holder 101 and the engaging pins 109 to be fitted into the drive groove portions 110*b* cooperate in forming a drive part which, according to the sliding displacement of the first connector 102, drives the slide members 105 so that they are slid and displaced; and, the operation groove portions 125*b* of the engaging grooves 125 respectively formed in the slide members 105 and the driven pins 123 to be engaged with the operation groove portions 125*b* cooperate in forming an operation part which increases the drive force of the slide members 105 and transmits the thus increased drive force to the connecting portions of the first and second connectors 102 and 104 to thereby drive the two connectors 102 and 104 in a direction where they can be connected.

To connect together the above-structured first and second connectors 102 and 104, the first connector 102 having its female-type terminals 115 assembled into the male-type connector housing 114 is disposed opposingly to the opening of the leading end portion of the holder 101 as shown by a virtual line in FIG. 3 and, after then, the connector housing 114 is pushed in a direction of an arrow shown in FIG. 3 and is inserted into the holder 101, so that the first connector 102 can be set at a connection wait position as shown by a solid line in FIG. 3.

In other words, as the first connector 102 is inserted into the holder 101, the projecting portions 117 of the connector housing 114 are respectively pressed against the tapered surfaces 112*c* of the removal prevention portions 112 provided in the horizontal plates 106 of the holder 101, so that the removal prevention portions 112 are elastically deformed. And, the projecting portions 117 are fitted into the holder 101 beyond the securing stepped portions 112*b* of the removal prevention portions 112 and, as shown in FIG. 4, the first connector 102 is provisionally secured at the connection wait position where the projecting portions 118*c* of the provisionally securing portions 118 provided on the side surfaces of the connector housing 114 are brought into contact with the front surfaces of the projections 119 respectively provided on the two side plates 107 of the holder 101. Also, in the above-mentioned insertion operation of the first connector 102, the engaging pins 109 provided on the rear end portions of the slide members 105 are respectively introduced into the guide-grooves 110 of the holder 101 and the engaging pins 109 are respectively engaged with the rear end positions of the introduction portions 110*a* of the guide grooves 110.

Next, after the holder 101 is mounted onto the mounting portion S of the vehicle body, if the electronic unit 122 with the second connector 104 mounted thereon is disposed opposingly to the installation position of the first connector 102 and is pushed toward the first connector 102, then the connector housing 120 of the second connector 104 can be fitted over and assembled with the connector housing 114 of the first connector 120, so that the first and second connectors 102 and 104 can be connected with each other in such a manner that they are held in electric conduction.

Figure 7:
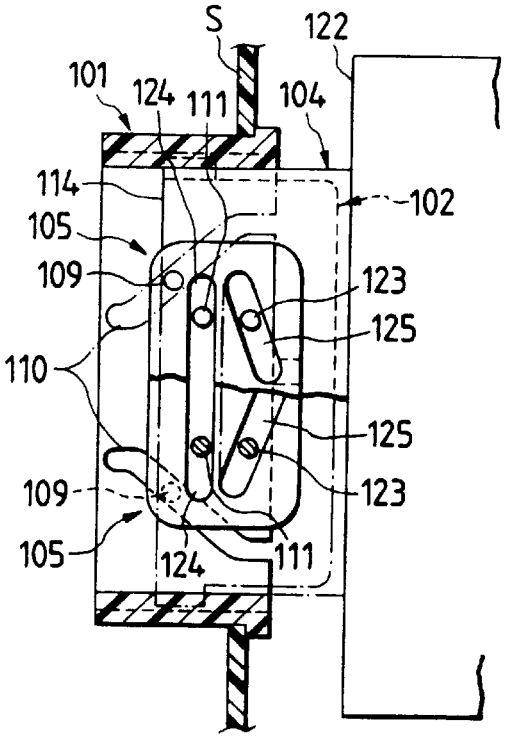
FIG. 7 is a sectional plan view of the first embodiment, showing a connecting process in which the first and second connectors are connected to each other.

Since the first connector 102 is pushed backwardly by the second connector 104 in response to the connecting operation of the two connectors 102 and 104, the projecting portions 118*c* of the provisionally securing portions 118 provided on the side surfaces of the second connector 104 are respectively pressed against the projections 119 of the holder 101, so that the plate-shaped portions 118*b* of the provisionally securing portions 118 are elastically deformed. And, after the projecting portions 118*c* of the provisionally securing portions 118 are moved beyond the projections 119 of the holder 101, not only the connector housing 114 of the first connector 102, as shown in FIG. 7, is slid and displaced backwardly along the inner wall surface of the holder 101, but also the driven pins 123 of the second connector 104 are respectively introduced into the engaging grooves 125 of the slide members 105 so that the driven pins 123 can be engaged with the slide members 105.

Also, due to the fact that the engaging pins 109 of the slide members 105 are slid backwardly and inwardly along the drive groove portions 110*b* of the guide grooves 110 in response to the backward sliding displacement of the first connector 102, the slide members 105 are slid and displaced toward the central portion of the first connector 102 while they are being supported by the connecting pins 111 and, in response to the sliding displacement of the slide members 105, the driven pins 123 of the second connector 104 are driven by the slide members 105 and are thereby drawn toward the first connector 102.

Figure 8:
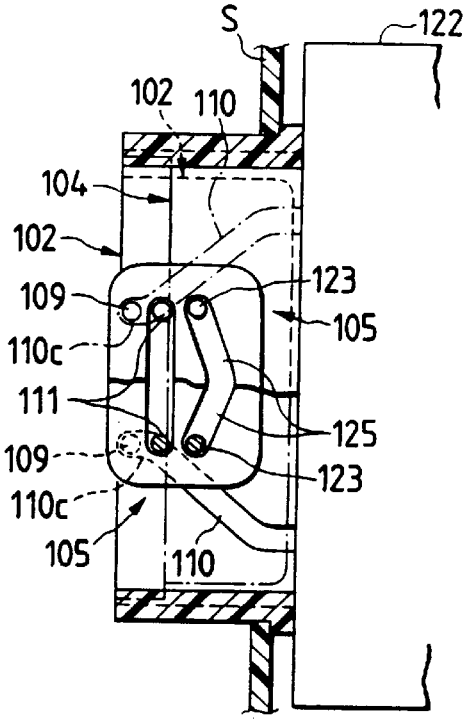
FIG. 8 is a sectional plan view of the first embodiment, showing the connected condition of the first and second connectors.

That is, because the operation groove portions 125*b* extending backwardly and inwardly are formed in the engaging grooves 125 of the slide members 105 engaged with the driven pins 123, when the operation groove portions 125*b* are slid and displaced along the driven pins 123 of the second connector 104 in response to the sliding displacement of the slide members 105, then the driven pins 123 are drawn toward the connecting pins 111 and, after then, the two connectors 102 and 104 are shifted to their connected condition shown in FIG. 8.

Also, the inclination angle of the drive groove portions 10*b* forming the drive part for driving the slide members 105 with respect to the connecting direction of the two connectors 102 and 104 is set larger than the inclination angle of the operation groove portions 125*b* forming the operation part for driving the second connector 104, so that, in the above-mentioned connecting operation of the first and second connectors 102 and 104, the drive force input to the slide members 105 can be increased according as the first connector 102 is slid and displaced backwardly and the thus increased drive force can be transmitted to the driven pins 123. Due to this, according to such drive force, the second connector 104 can be pushed toward the first connector 102 with a great force, so that the first and second connectors 102 and 104 can be connected together reliably.

And, in the connected condition of the first and second connectors 102 and 104, as shown in FIG. 8, the engaging pins 109 of the slide members 105 are respectively introduced and locked into the securing portions 110*c* of the guide grooves 110. Therefore, even if the connecting portions of the two connectors 102 and 104 are loosened and the engaging pins 109 are thereby moved forwardly to a slight extent, there is no possibility that the drive force for sliding and displacing the slide member 105 can be given to the two connectors 102 and 104, so that the two connectors 102 and 104 can be maintained in the stably connected condition. Also, due to the fact that, in the range of installation of the above-mentioned securing portions 110*c*, the first and second connectors 102, 104 and slide members 105 are integrally moved backwardly of the holder 101, even if the amount of push-in movement of the electronic unit 122 varies to some extent, the two connectors 102 and 104 can be shifted to a completely connected condition.

To remove the above-mentioned connected condition between the first and second connectors 102 and 104, if the electronic unit 122 is pulled to thereby slide and displace the second connector 104 to a connection removing position, then the slide members 105 can be slid and displaced in the opposite direction to the above-mentioned connecting operation and the first connector 102 can slid and displaced forwardly, so that the two connectors 102 and 104 can be removed from their mutually connected condition.

According to the present embodiment, as described above, the first connector 102 is supported by the holder 101 mounted on the mounting portion S of the vehicle body in such a manner that the first connector 102 can be slid in the connecting direction thereof, the slide members 105 are provided in such a manner that they can be slid and displaced in a direction at right angles to the connecting direction of the two connectors 102 and 104 according to the sliding displacement of the first connector 102, and the drive force of the slide members 105 can be increased according to the sliding displacement thereof and the thus increased drive force of the slide members 105 can be transmitted to the connecting portions of the first and second connectors 102 and 104, so that the two connectors 102 and 104 can be driven in a direction where they can be connected together. Due to this structure, a sufficiently large connecting force can be given to the two connectors 102 and 104 by a simple operation to push the second connector 104 in a direction where it can be connected with the first connector 102.

Therefore, even in a connector of a multi-polar structure in which a large number of female-type terminals 115 and male-type terminals 121 are disposed in the first and second connectors 104, the two connectors 102 and 104 can be positively shifted to their connected condition with one touch. Also, even in a case in which the second connector 104 is disposed on the back surface side of the electronic unit 122 comprising the meter unit, air conditioning unit, navigation device or the like of the vehicle and also in which the first connector 102 is mounted on the bottom portion of a mounting hole in which such electronic unit 122 is to be mounted, that is, even in a case in which it is impossible to insert the hand of an operator into the connecting portions of the two connectors 102 and 104, the connecting operation of the two connectors 102 and 104 can be executed easily and positively.

Further, since the connecting operation of the two connectors 102 and 104 can be carried out by driving the slide member 105 without securing an operation space for driving the slide member 105 laterally of the installation portion of the connector, there is eliminated the need to provide a large dead space laterally of the installation portion of the connector, thereby being able to make effective use of the space of the connector.

Still further, according to the above-mentioned embodiment, because the plate-shaped slide members 105 are interposed between the inner wall surface of the holder 101 and the outer wall surface of the first connector 102, it is possible to reduce the slide members installation space formed between the inner wall surface of the holder 101 and the outer wall surface of the first connector 102, which in turn makes it possible to effectively prevent the connector from increasing in the vertical dimension thereof.

According to a further aspect of the above-mentioned embodiment, the two slide members 105 are respectively arranged on the top and bottom portions of the first connector 104, whereby not only the two slide members 105 can be supported in such a manner that they can be freely slid along the mutually opposing wall surfaces of the holder 101 but also the two slide members 105 can be arranged at symmetrical positions to each other. Due to this structure, while the two slide members 105 are being slid and displaced toward the central portion of the connector, if a great drive force is given to the respective two end portions of the two slide members 105 on the diagonal line of the two connectors 102 and 104, then uniform connecting forces can be applied to the respective portions of the two connectors 102 and 104 and thus the two connectors 102 and 104 can be connected properly by a simple structure.

Also, in the above-mentioned case where the two connectors 105 are arranged at symmetrical positions, the slide members 105 can be formed in the same shape, thereby being able to improve the productivity of the slide members 105. For reference, instead of use of the above-mentioned structure, it is also possible to employ a structure in which the slide member 105 is provided only on one of the top and bottom portion of the first connector 102, or a structure in which a pair of right and left slide members 105 are respectively provided on both of the top and bottom portions of the first connector 102.

According to a still further aspect of the above-mentioned embodiment, the removal prevention portions 112 are respectively formed in the horizontal plates 106 of the holder 101 and the projecting portions 117 corresponding to the securing stepped portions 112*b* of the removal prevention portions 112 are provided on the connector housing 114 of the first connector 102. Due to this, by bringing the projecting portions 117 into contact with the securing stepped portions 112*b*, the holder 101 and first connector 102 can be kept in a stably connected condition.

Also, as mentioned above, the tapered surfaces 112*c* are respectively formed in the outer surfaces of the leading end portions of the securing stepped portions 112*b*, and the slits 112*a* are respectively interposed between the horizontal plates 106 and removal prevention portions 112 of the holder 101. Therefore, in a structure in which the projecting portions 117 of the connector housing 114 can be respectively pressed against the tapered surfaces 112*c* of the securing stepped portions 112*c* and the removal prevention portions 112 can be thereby deformed elastically, a connecting operation to connect the first connector 102 to the holder 101 can be executed easily with one touch. Further, by deforming the removal prevention portions 112 elastically, the first connector 102 within the holder 101 can also be taken out of the holder 101.

According to another aspect of the above-mentioned embodiment, the provisionally securing portions 118 are formed on the two right and left side surfaces of the connector housing 114 and, as shown in FIG. 4, the projecting portions 118*c* of the provisionally securing portions 118 are contacted with the front surface of the holder 101 so that the first connector 101 can be secured provisionally at the connection wait position. Thanks to this, the possibility that the first connector 102 can be pushed into the holder 101 prior to execution of the above-mentioned connectors connecting operation can be prevented effectively by a simple structure.

And, when each of the provisionally securing portions 118 is composed of the base end portion 18*a* provided on and projected from the side wall surface of the connector housing 114, the plate-shaped portion 18*b* which is disposed opposed to the side wall surface of the connector housing 114 at a given space therefrom and also which extends forwardly, and the projecting portion 118*c* which is provided on the outer surface of the leading end portion of the plate-shaped portion 118*b*, a pair of tapered surfaces are formed in the outer side surface of the projecting portion 118*c*, and there is provided on the front surface of the holder 101 the projection 119 which includes a pair of tapered surfaces corresponding to the pair of tapered surfaces of the projecting portion 118*c*, if the tapered surfaces are respectively pressed against each other to thereby deform the plate-shaped portion 118*b* elastically, then the provisionally secured condition of the first connector 102 by the provisionally securing portions 118 can be removed easily with one touch.

However, instead of the provisionally securing portions 118, it is also possible to employ another structure in which there is provided an energizing member for energizing the first connector 102 forwardly, and the projecting portions 116 of the connector housing 114 are respectively contacted with the securing stepped portions 112*b* of the removal prevention portions 112 according to the energizing force of the energizing member, thereby being able to secure the first connector 102 at the above-mentioned connection wait position.

Figure 9:
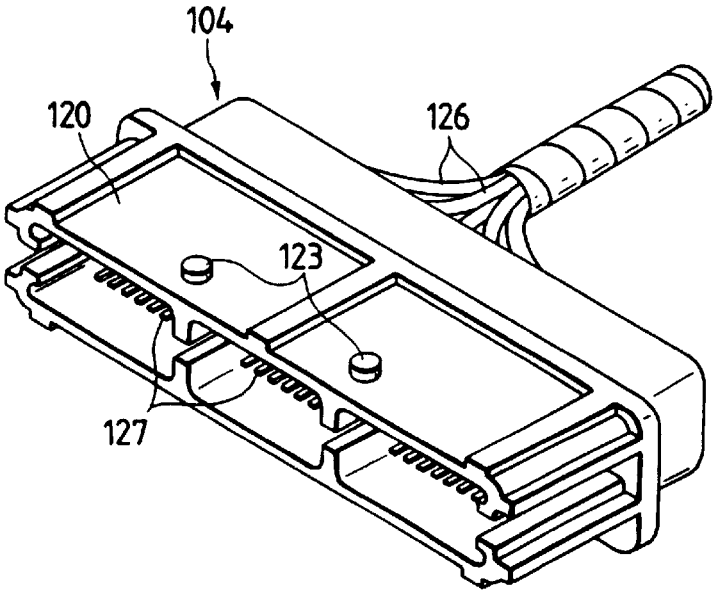
FIG. 9 is a perspective view of another embodiment of the second connector.

Also, it is not always necessary that the second connector 104 to be connected to the first connector 102 is mounted on the circuit board 103 provided in the electronic unit 122 but, as shown in FIG. 9, a second connector 104, which includes a female-type connector housing 120 and a plurality of male-type terminals 127 respectively having harnesses 126 connected to the rear end portions thereof, may be directly connected to the above-mentioned first connector 102. Further, it is not always necessary that the holder 101 and first connector 102 are supported on the mounting portion S of the vehicle body, but it is also possible to employ a structure in which an operator holds the holder 101 and first connector 102 by hand and connects them to the above-mentioned second connector 104 directly.

In the above-mentioned embodiment, description has been given of the case in which the first connector 102 supported slidably by the holder 101 is mounted on the mounting portion S of the vehicle body and the second connector 104 to be connected to the first connector 102 is mounted in the electronic unit 122. However, this is not limitative but it is also possible to employ a structure in which a first connector 102 including slide members 105, a male-type connector housing 114 and the like as well as the holder 101 are installed in the above-mentioned electronic unit 122, and a second connector 104 including a female-type connector housing 120 and the like is disposed in the above-mentioned mounting portion S. In this case, the electronic unit 122 is used as a mounting portion for mounting the first connector 102 thereon.

Also, instead of the above structure in which the engaging pins 109 projectingly provided on the slide members 105 are introduced into and engaged with the guide grooves 110 formed in the connector housing 114 of the first connector 102, there may be employed a structure in which engaging pins 109 are provided on the above-mentioned connector housing 114 and guide grooves 110 engageable by the present-engaging pins 9 are formed in the above-mentioned slide members 105. Further, it is also possible to employ another structure of a type that driven pins 123 are projectingly provided on the lower surfaces of the leading end portions of the above-mentioned slide members 105 and engaging grooves 125 into which the present driven pins 123 can be introduced for engagement are respectively formed in the connector housing 120 of the above-mentioned second connector 104.

Further, in the above-mentioned embodiment, description has been given of the case in which the slide members 105 are slidably supported on the connector housing 114 of the first connector 102 and the drive parts for sliding and displacing the slide members 105 are interposed between the slider members 105 and holder 101. However, this is not limitative but it is also possible to employ a structure in which the above-mentioned connecting pins 11 and guide grooves 124 for supporting the slide members 105 slidably in the holder 101 are respectively interposed between the slide members 105 and holder 101 to thereby allow the holder 101 to support the slide members 105, and a drive part consisting of the above-mentioned engaging pins 109 and guide grooves 110 is interposed between the connector housing 114 of the first connector 102 and slide members 105.

As has been described heretofore, according to the first aspect of the invention, there is provided in a holder a support portion for supporting a first connector in such a manner that the first connector can be slid in a direction where first and second connectors can be connected, and there is provided a slide member which can be slid and displaced in a direction at right angles to the connecting direction of the two connectors according to the sliding displacement of the first connector, whereby a drive force input to the two slide members can be increased and the thus increased drive force can be transmitted to the connecting portions of the first and second connectors, so that the two connectors can be driven in a direction where they can be connected together. Due to this structure, a strong connecting force can be applied to the connecting portions of the two connectors by a one-touch operation to connect the second connector to the first connector. Therefore, even when a connector of a multipolar structure having a large connecting resistance is disposed at a position into which an operator to cannot insert his or her hand, the connecting operation of the two connectors can be executed easily and positively as well as it is possible to prevent a dead space from being generated laterally of the present connector, thereby being able to control the installation space of the connector down to a minimum.

Also, according to the invention, since a plate-shaped slide member is interposed between the inner wall surface of the holder and the outer wall surface of the first connector, the installation space of the slide member formed between the inner wall surface of the holder and the outer wall surface of the first connector can be reduced, which makes it possible to effectively prevent the connector from increasing in the vertical dimension thereof.

Further, according to the invention, a pair of slide members are installed in the connecting portions of the first and second connectors and the two slide members are arranged at symmetrical positions to each other. Due to this, as the first connector is slid and displaced according to the drive force for connecting the first and second connectors, if a great connecting force is applied to the two diagonally located end portions of the two connectors from the two slide members, then uniform connecting forces can be applied to the respective parts of the two connectors and thus the two connectors can be connected together properly by a simple structure. Also, because the two slide members having the same shape can be disposed on the top and bottom portions of the first connector, the productivity of the slide members can be improved and thus the manufacturing costs thereof can be reduced.

Still further, according to the invention, since there is formed in the connecting portion of the holder and first connector a removal prevention portion which is used to prevent the first connector supported by the holder from being pulled out of the holder, the connected condition of the holder and first connector can be maintained stably, that is, it is possible to effectively prevent the possibility that the first connector can be removed from the holder.

Yet further, according to the invention, in the connecting portion of the holder and first connector, there is provided a provisionally securing portion for securing the first connector at a connection wait position thereof provisionally and the provisionally secured condition of the first connector by the provisionally securing portion can be removed according to an operation force for connecting the first and second connectors to each other. Due to this structure, not only it is possible to prevent the possibility that the first connector can be pushed into the holder prior to execution of the connecting operation of the two connectors but also, in the two connectors connecting operation, the provisionally secured condition of the first connector by the provisionally securing portion can be removed with one touch.

Second Embodiment

Figure 10:
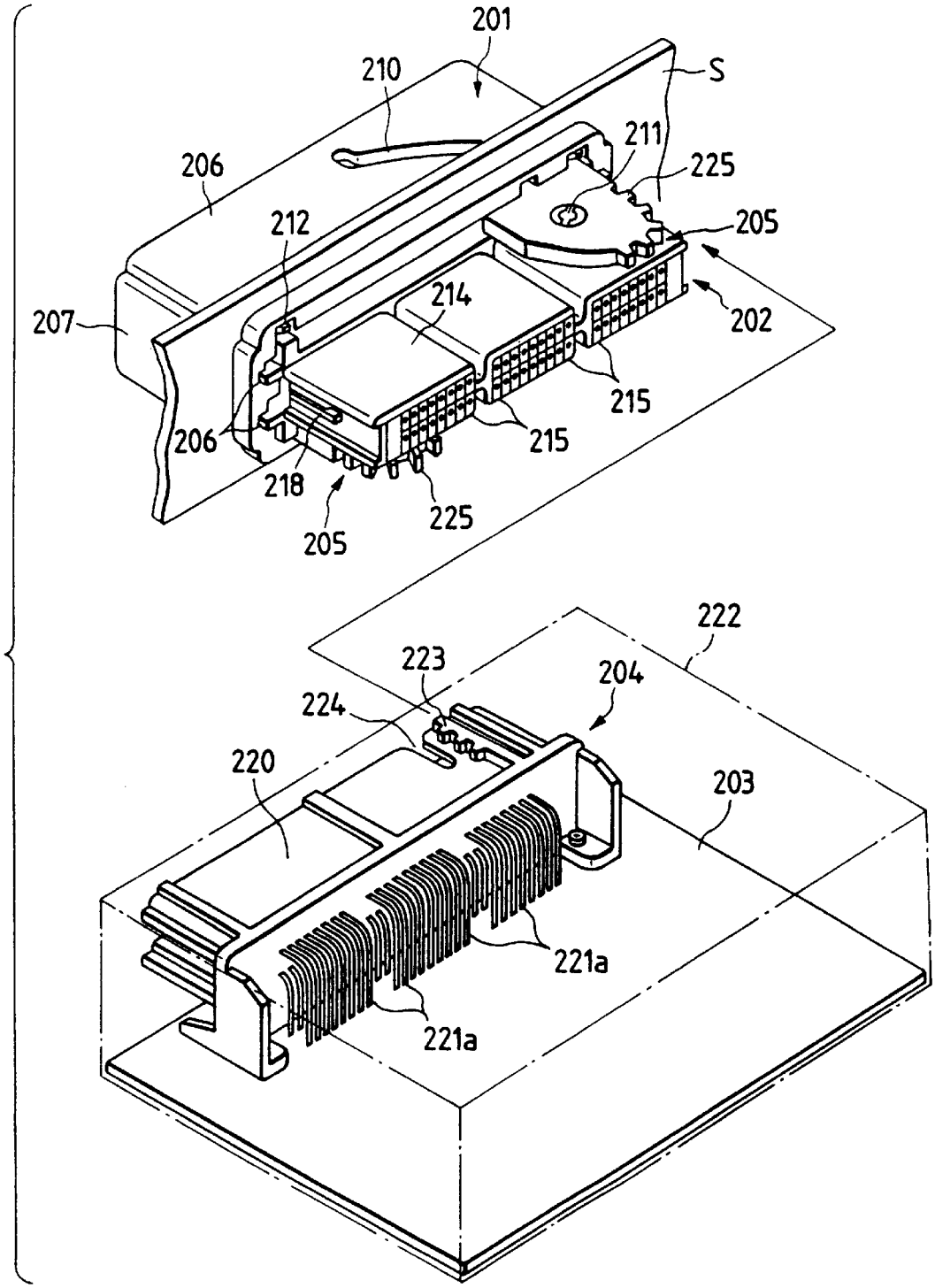
FIG. 10 is a perspective view of a second embodiment of a connector connecting structure according to the invention.

Now, FIG. 10 shows a second embodiment of a connector connecting structure according to the invention. The present connector comprises a holder 201 mounted on a mounting portion S which consists of a stay member of a vehicle or the like, a first connector 202 supported slidably by the holder 201, a second connector 204 mounted on a circuit board 203 which forms part of an electronic unit 222, and two upper and lower swingable members 205 are respectively used to drive the second connector 204 in a direction where the second connector 204 can be connected to the first connector 202.

Figure 11:
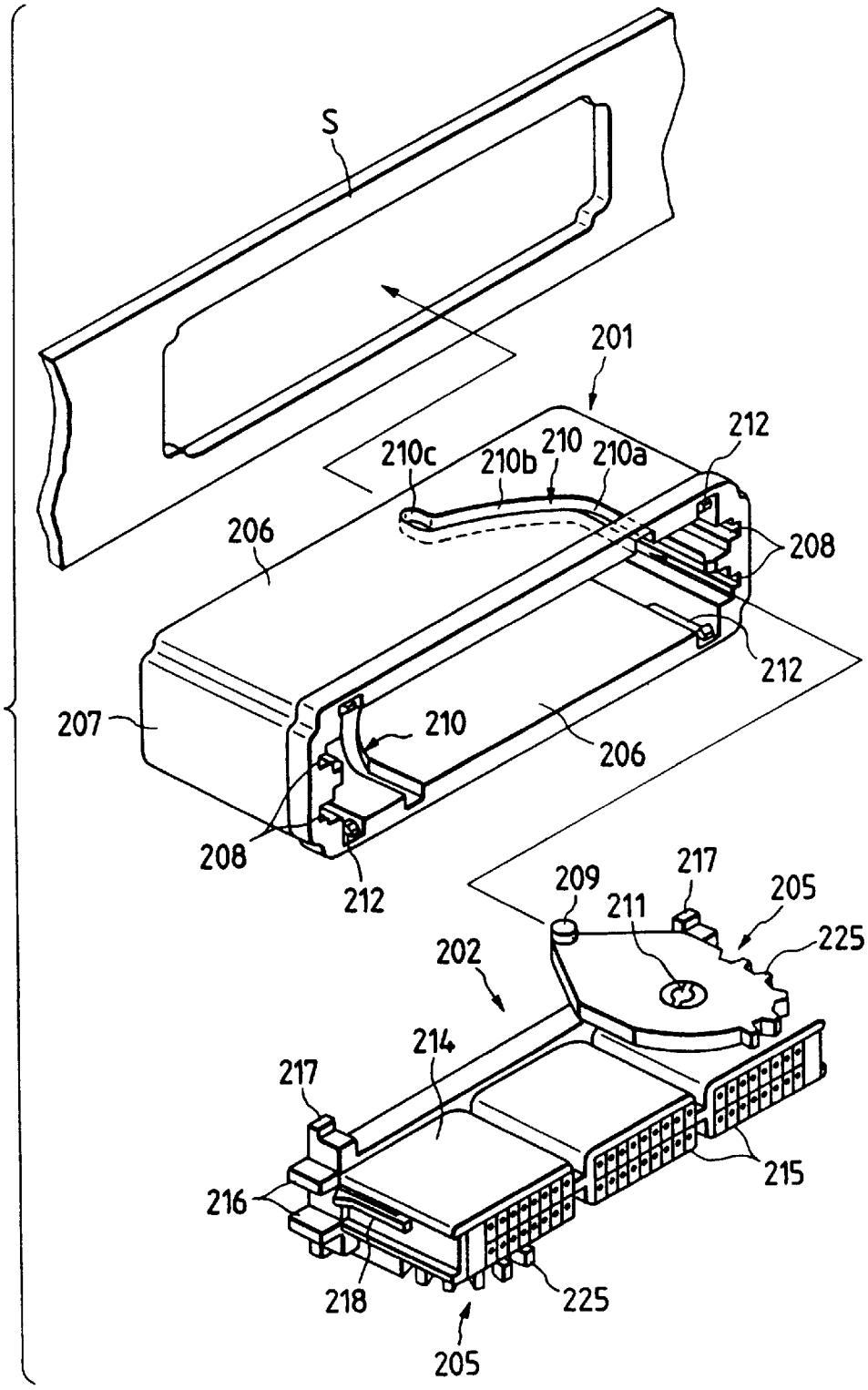
FIG. 11 is an exploded perspective view of a concrete structure of a first connector employed in the second embodiment.

The above-mentioned holder 201, as shown in FIG. 11, is so formed as to have a tubular shape which includes a pair of upper and lower horizontal plates 202 and a pair of right and left side plates 207, while the holder 201 is also structured such that it can be fitted into a mounting hole formed in the mounting portion S and can be fixed thereto by screwing or by similar fixing means. Also, in the respective inner wall surfaces of the two right and left side plates 207, there are formed support portions-which respectively extend in the horizontal direction and are used to support the first connector 202 in a freely slidable manner, while each of the support portions consists of a pair of upper and lower recessed grooves 208.

Each of the swingable members 205 includes an engaging pin 209 which is provided on and projected from the upper surface of the rear end portion of the swingable member 205. On the other hand, each of the horizontal plates 206 includes a guide groove 210. The engaging pin 209 can be engaged with the guide groove 210. The guide groove 210 includes an introduction portion 210*a* extending backwardly from the front end portion of the holder 201, a drive groove portion 210*b* extending backwardly and inwardly from the end portion of the introduction portion 210*a*, and a securing portion 210*c* extending backwardly from the end portion of the drive groove portion 210*b*. In the present embodiment, the drive groove portion 210*b* is formed such that it extends backwardly and inwardly of the end portion of the holder 201 in a curved line. However, the drive groove portion 210*b* may also be formed such that it extends backwardly and inwardly from the end portion of the introduction portion 210*a* in a straight line.

Also, the guide groove 210 formed in the upper horizontal plate 206 is formed at a position which is symmetrical to the position of the guide groove 210 formed in the lower horizontal plate 206 with respect to a point. That is, in the present embodiment, when viewed from the front surface side of the holder 201, the guide groove 210 is formed on the right side of the upper horizontal plate 206, while the guide groove 210 is formed on the left side of the lower horizontal plate 206.

Figure 12:
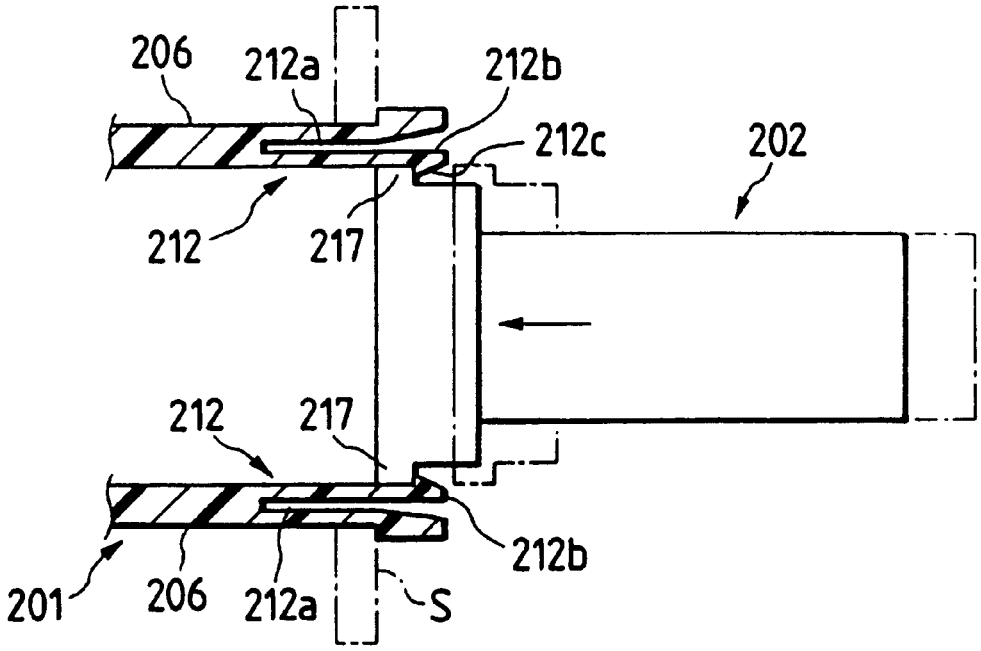
FIG. 12 is a sectional side view of the second embodiment, showing a state thereof in which the first connector is secured to a holder by removal prevention portions.

The two horizontal plates 206 of the holder 201, as shown in FIG. 12, respectively include slits 212*a* which are respectively formed on the right and left portions of the inner wall surfaces of the horizontal plates 206 and also which are also so formed as to have a given width. Due to provision of the slits 212*a*, there is provided a removal prevention portion 212 which secures the first connector 202 at its forward wait position, while the removal prevention portion 212 includes in the leading end portion thereof securing stepped portions 212*b* which are respectively disposed opposed to projecting portions 217 formed in the rear portion of the first connector 202. And, in operation, the front surfaces of the projecting portions 217 are contacted with the rear surfaces of the securing stepped portions 212*b* to thereby be able to prevent the first connector 202 from being removed forwardly from the holder 201. Also, each of the securing stepped portions 212*b* includes a tapered surface on the outer surface of the leading end portion thereof, so that the securing stepped portion 212*b* is so formed as to have a forwardly tapered shape.

The first connector 202 includes a male-type connector housing 214 which can be inserted into the holder 201 and can be supported slidably therein, and a plurality of female-type terminals which are respectively disposed within a terminal storage chamber formed in the connector housing 214. The connector housing 214 includes a pair of upper and lower projecting portions 216 which are respectively formed on the right and left side surfaces of the rear end portion of the connector housing 214 in such a manner that they can be slid along the recessed grooves 208 of the holder 201. Also, the connector housing 214 further includes projecting portions 217 which are provided on the right and left sides of the upper and lower surfaces of the rear end portion thereof in such a manner that they can be secured to the securing stepped portions 212*b* of the removal prevention portion 212.

Figure 13:
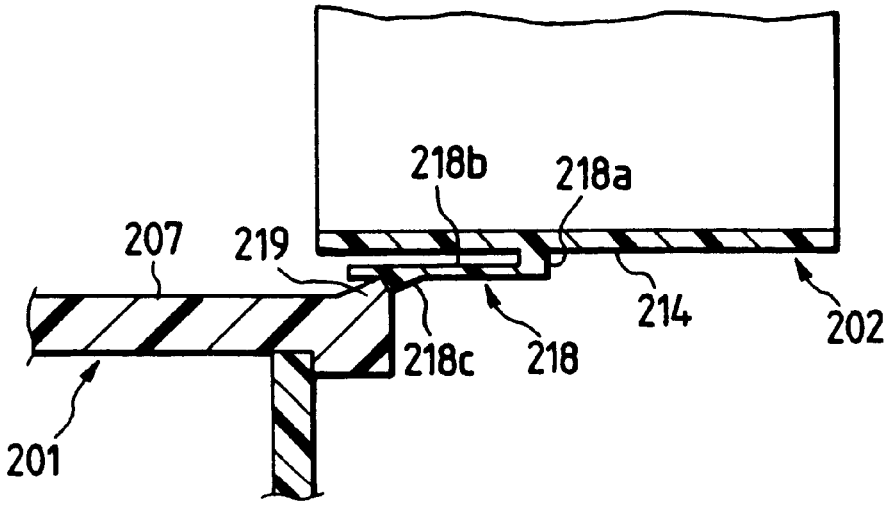
FIG. 13 is a sectional plan view of the second embodiment, showing a state thereof in which the first connector is provisionally secured at a connection wait position by provisionally securing portions.

Also, on the right and left side surfaces of the connector housing 214, as shown in FIG. 13, there are formed provisionally securing portions 218 which are used to secure the first connector 202 provisionally at the above-mentioned connection wait position to thereby prevent the first connector 202 from being pushed into the holder 201 before the execution of a connector connecting operation to be described later. Each of the provisionally securing portions 218 includes a base end portion 218*a* projectingly provided on the side wall surface of the connector-housing 214, a plate-shaped portion 218*b* which extends backwardly while it is opposed to the side wall surface of the connector housing 214 with a given clearance between them, and a projecting portion 218*c* which is projectingly provided on the outer surface of the rear portion of the plate-shaped portion 218*b*.

The projecting portion 218*c* of the provisionally securing portion 218, when viewed from a plane thereof, is so formed as to have a triangular shape and, on the outer side surface thereof, there are formed a pair of tapered surfaces. Also, on the front surface of the holder 201, there is provided a projection 219 which includes a pair of tapered surfaces respectively corresponding to the tapered surfaces of the projecting portion 218*c*. And, in operation, the rear tapered surface of the projecting portion 218*c* provided in the provisionally securing portion 218 is contacted with the front tapered surface of the projection 219 provided on the holder 201 to thereby be able to secure the first connector 202 provisionally at the connection wait position.

Figure 14:
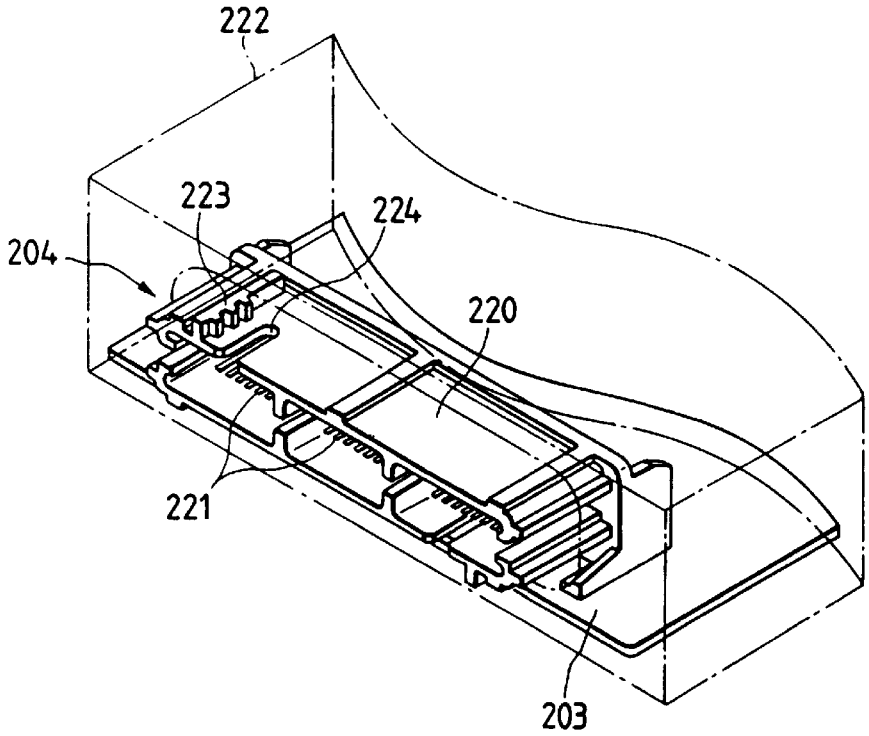
FIG. 14 is a perspective view of a concrete structure of a second connector employed in the second embodiment.
Figure 15:
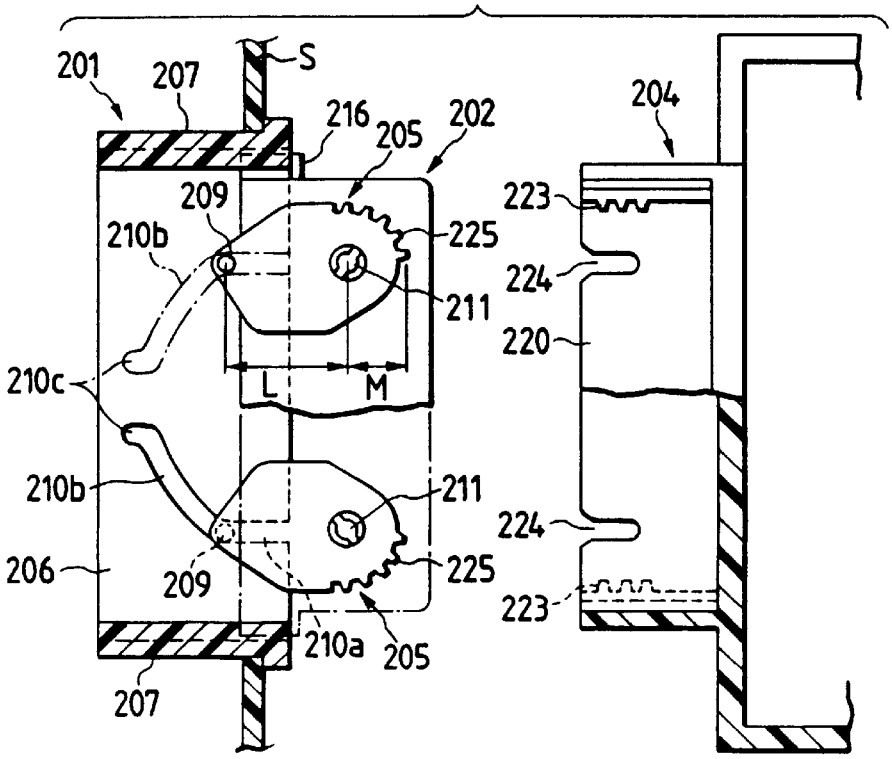
FIG. 15 is a sectional plan view of the second embodiment, showing a state thereof before the first and second connectors are connected to each other.

The second connector 204, as shown in FIG. 14, includes a female-type connector housing 2which can be fitted over and engaged with the connector housing 214 of the first connector 202, and a plurality of male-type terminals 221 respectively disposed within a terminal storage chamber formed in the connector housing 220. The connector housing 220 is fixed onto the circuit board 203 by screwing or by other similar fixing means, while the connecting portions 221*a* of the male-type terminals 221 are respectively guided out from the rear end portion of the connector housing 220 and are connected to the introduction portion of the circuit board 203 by soldering or by other similar connecting means (see FIG. 10).

Also, the above-mentioned second connector 204 and circuit board 203 are respectively stored within a case for covering an electronic unit 222. The connector housing 220 further includes on the top wall portion and bottom wall portion thereof rack portions 223 which are formed at the positions thereof respectively corresponding to the installation positions of the swingable members 205. The connector housing 220 still further includes on the top and bottom wall portions thereof slits 224 which are formed at the positions thereof respectively corresponding to the support shafts 211 of the swingable members 205.

Each of the above-mentioned swingable members 205 is formed of a plate member which is interposed between the inner wall surface of the holder 201, which is composed of the lower surface of the upper horizontal plate 206 and the upper surface of the lower horizontal plate 206, and the outer wall surface of the first connector 202 composed of the upper and lower surfaces of the connector housing 214; and, the swingable member 205 is swingably supported by the connector housing 214 of the first connector 202 through the support shaft 211. In particular, the upper swingable member 205 includes an engaging pin 209 which is provided on the upper surface of the rear end portion thereof, while the lower swingable member 205 includes an engaging pin 209 which is provided on the lower surface of the rear end portion thereof; and, the engaging pins 209 can be respectively fitted into and engaged with the guide grooves 210 of the holder 201. Also, each swingable member 205 includes in the leading end portion thereof a sector-gear-shaped pinion portion 225 which can be rotated about the support shaft 211, while the pinion portion 225 of the swingable member 205 can be meshingly engaged with the rack portion 223 of the second connector 204.

Now, a distance L between the engaging pin 209 and the support shaft 211 serving as the swingable support point of the swingable member 205 is set for a value which is larger than the value of a distance M between the pinion portion 225 and support shaft 211. And, in the connecting operation of the two connectors which will be discussed later, as the first connector 202 is pushed into the holder 201 and is slid therein, a drive force is input from the guide grooves 210 of the holder 201 into the engaging pins 209 so that the swingable members 205 can be swung and displaced and, at the same time, the above-mentioned drive force is transmitted from the pinion portions 225 to the rack portions 223 of the second connector 204 so that the second connector 204 can be driven or moved toward the first connector 202 with a great force.

That is, the guide grooves 210 of the holder 201 and the engaging pins 209 of the swingable member 205 are used to form a drive part which can swingable and displace the swingable members 205; and, in order that the drive force to input from such drive part into the swingable members 205 can be increased according to the principles of leverage and the thus increased drive force can be then transmitted to the connector housing 220 of the second connector 204, the distance L from the drive part to the support shaft 211 of the swingable member 205 is set for a value larger than the value of the distance M from the pinion portion 225 to the support shaft 211, for example, about twice. Due to this, the moving distance of the second connector 204 which is moved relatively with respect to the first connector 202 becomes shorter than the moving distance of the first connector 202 which is moved when it is pushed into the holder 201, thereby being able to apply a great connecting force to the connecting portions between the first connector 202 and second connector 204.

To connect together the first connector 202 and second connector 204 structured in the above-mentioned manner, the first connector 202 with the female-type terminals 215 thereof assembled into the male-type connector housing 214, as shown by a virtual line in FIG. 12, is firstly disposed opposed to the leading end opening of the holder 201 and the connector housing 214 is then pushed in a direction of an arrow shown in FIG. 12 and is thereby inserted into the holder 201, so that the first connector 202 can be set at a connection wait position as shown by a solid line in FIG. 12.

That is, according to the insertion operation of the first connector 202 into the holder 201, the projecting portions 217 of the connector housing 214 of the first connector 202 are respectively pressed against the tapered surfaces 212*c* of the removal prevention portions 212 provided in the horizontal plates 206 of the holder 201, so that the removal prevention portions 212 can be elastically deformed. And, the projecting portions 217 are moved beyond the securing stepped portions 212*b* of the removal prevention portions 212 and are then inserted into the holder 201, with the result that, as shown in FIG. 13, the first connector 202 can be secured provisionally at the connection wait position where the projecting portions 218*c* of the provisionally securing portions 218 provided in the side surfaces of the connector housing 214 are respectively in contact with the front surfaces of the projecting portions 219 provided in the side plates 207 of the holder 201. Also, in the above-mentioned insertion operation of the first connector 202, the engaging pins 209 provided in the rear end portions of the swingable members 205 are respectively introduced into the guide grooves 210 of the holder 201, while the engaging pins 209 are engaged with the respective rear end positions of the introduction portions 210*a* of the guide grooves 210.

Next, after the holder 201 is mounted onto the mounting portion S provided on the vehicle body side, if the electronic unit 222 with the second connector 204 mounted thereon is pushed while it is disposed opposed to the installation portion of the first connector 202, then the connector housing 220 of the second connector 204 can be fitted over the connector housing 214 of the first connector 202, so that the first and second connectors 202 and 204 can be connected together and held in electric conduction with each other.

Figure 16:
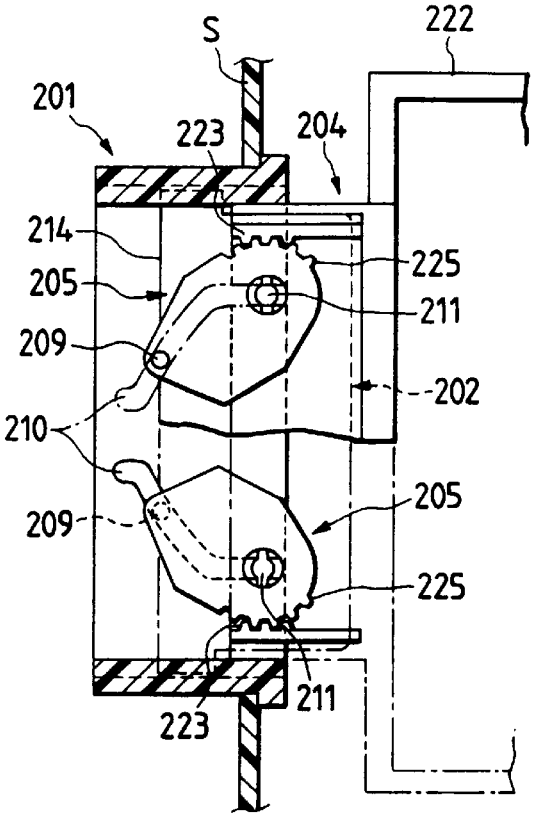
FIG. 16 is a sectional plan view of the second embodiment, showing a process for connecting the first and second connectors to each other.

In the above-mentioned connecting operation of the two connectors 202 and 204, due to the fact that the first connector 202 is pushed backwardly by the second connector 204, the projecting portions 218*c* of the provisionally securing portions 218 provided in the side surfaces of the second connector 204 are pressed against the projections 219 of the holder 201, so that the plate-shaped portions 218*b* of the provisionally securing portions 218 can be deformed elastically. And, after the projecting portions 218*c* of the provisionally securing portions 218 are moved beyond the projections 219 of the holder 201, the connector housing 214 of the first connector 202, as shown in FIG. 16, is slid backwardly along the inner wall surfaces of the holder 201 and, at the same time, the rack portions 223 of the second connector 204 are engaged with the pinion portions 225 of the swingable members 205.

As the engaging pins 209 of the swingable members 205 are slid backwardly and inwardly along the drive groove portions 210*b* of the guide grooves 210 in response to the backward sliding movement of the first connector 202, the swingable members 205 are respectively swung and displaced about the support shafts 211 and, in response to such oscillating displacement of the swingable members 205, the rack portions 223 of the second connector 204 are respectively driven by the pinion portions 225 of the swingable members 205 and are thereby pushed toward the first connector 202.

That is, since the guide grooves 210 respectively include the drive groove portions 210*b* which extend backwardly and inwardly of the holder 201, as the first connector 202 is slid backwardly, the engaging pins 209 of the swingable members 205 are guided by the drive groove portions 210*b* and the rear end portions of the swingable members 205 are swung and displaced backwardly and inwardly, so that the leading end portions of the swingable members 205 are swung and displaced backwardly and outwardly. Due to this, while the rack portions 223 of the second connector 204 are in meshing engagement with the pinion portions 225 of the swingable members 205, the pinion portions 225 are rotated to thereby be sure to transmit a drive force in a direction where the rack portions 223 and second connector 204 are moved toward the first connector 202, so that the two connectors 202 and 204 can be turned into a connected condition shown in FIG. 17.

Also, since the distance L from the engaging pin 209 forming part of the drive part for driving the swingable members 205 to the support shaft 211 is set greater than the distance M from the rack portion 223 to the support shaft 211, in the connecting operation of the first and second connectors 202 and 204, the drive force input to the swingable members 205 according to the backward sliding motion of the first connector 202 can be increased before it is transmitted to the rack portions 223, and the second connector 204 can be pushed toward the first connector 202 with a great force, so that the first and second connectors 202 and 204 can be connected together positively.

Figure 17:
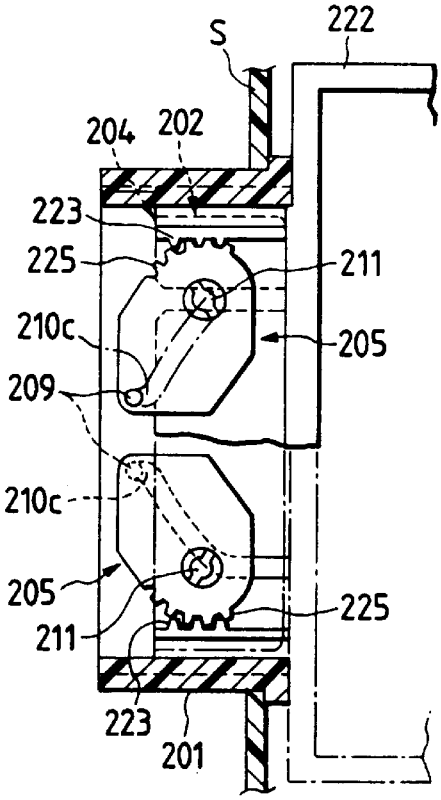
FIG. 17 is a sectional plan view of the second embodiment, showing the connected condition of the first and second connectors.

And, in the connected condition of the first and second connectors 202 and 204, as shown in FIG. 17, the engaging pins 209 of the swingable members 205 are respectively introduced into and locked to the securing portions 210*c* of the guide grooves 210. Therefore, even if the connected portion of the two connectors 202 and 204 is loosened and the engaging pins 209 are thereby moved forwardly of the guide grooves 210 to a slight extent, there is no possibility that the drive force for sliding the swingable members 205 can be applied thereto, so that the two connectors 202 and 204 can be maintained in a stably connected condition. Still further, in the range of the installation position of the securing portions 210*c*, since the first and second connectors 202 and 204 as well as the swingable members 205 are moved backwardly of the holder 201 in an integral manner, even if the amount of push-in of the electronic unit 222 varies to some extent, the two connectors 202 and 204 can be turned into a perfectly connected condition.

To remove the connected condition between the first and second connectors 202 and 204, if the electronic unit 222 is pulled to thereby move the second connector 204 to a connection removing position, then the swingable members 205 are swung and displaced in the opposite direction to the direction of the above-mentioned connector connecting operation and the swingable members 205 and first connector 202 are slid forward, thereby being able to remove the connected condition between the two connectors 202 and 204.

Also, in the present embodiment, as described before, the first connector 202 is supported by the holder 201 mounted on the mounting portion S in such a manner that the first connector 202 can be slid in the connecting direction thereof, there are provided the swingable members 205 that can be swung and displaced according to the sliding motion of the first connector 202, and, in the swingable members 205 and second connector 204, there are further provided the pinion portions 225 and rack portions 223 which not only can increase the drive force of the swingable members 205 according to the oscillating displacement of the swingable members 205 and but also can transmit the thus increased drive force to the connected portions of the first and second connectors 202 and 204. Due to this, a great connecting force can be applied to the two connectors 202 and 204 by a simple operation, that is, by simply pushing the second connector 204 in a direction where the second connector 204 can be connected to the first connector 202.

Therefore, even in a connector of a multi-polar structure which includes a large number of female-type terminals 215 and male-type terminals 221 respectively disposed in the first and second connectors 202 and 204 and thus has a large connecting resistance, the two connectors 202 and 204 can be positively turned into a connected condition with one touch. Also, the second connector 204 is disposed on the back side of the electronic unit 222 consisting of the meter unit, air conditioning unit, navigation device or the like of a vehicle, and the first connector 202 is mounted on the bottom portion of the mounting hole in which the electronic unit 222 is to be mounted. Due to this, even when an operator is not able to insert his or her hand into the connected portions of the two connectors 202 and 204, the two connectors 202 and 204 can be connected together easily and positively.

Further, since the drive force can be given to the two connectors 202 and 204 by driving the swingable members 205 without securing in the installation portion of the connector an operation space for driving the swingable members 205, it is possible to prevent a dead space from being produced in the connector installation portion, which in turn makes it possible to make effective use of space.

In the above-mentioned embodiment, due to the fact that the plate-shaped swingable members 205 are interposed between the inner wall surface of the holder 201 and the outer wall surface of the first connector 202, the swingable member 205 installation space formed between the inner wall surface of the holder 201 and the outer wall surface of the first connector 202 can be reduced in size. This makes it possible not only to effectively prevent the connector from increasing in the vertical dimensions thereof but also to positively prevent the swingable members 205 from projecting outwardly from the connector installation portion.

Also, in the above-mentioned embodiment, the two swingable members 205 are respectively installed upwardly and downwardly of the first connector 202, the two swingable members 205 are arranged at positions which are symmetrical to each other with respect to a point, and, when viewed from a plane, the two swingable members 205 are structured such that they can be swung and displaced in the opposite direction to each other. Thanks to this structure, a great drive force can be applied to the respective end portions of the two connectors 202 and 204 on the diagonal lines thereof. That is, by use of a simple structure, the connecting force can be applied uniformly to the respective connected portions of the two connectors 202 and 204, thereby causing the second connector 204 to be slid and displaced straight, so that the two connectors 202 and 204 can be connected properly.

Further, as described above, when the two swingable members 205 are arranged at point symmetrical positions and are structured such that they can be swung and displaced in the opposite direction to each other, since the swingable members 205 can be so formed as to have the same shape, the productivity thereof can be enhanced. However, it should be noted here that it is not always necessary to arrange the two swingable members 205 at point symmetrical positions, but the two swingable members 205 can be arranged at arbitrary positions. Also, instead of the above-mentioned structure, there may be employed a structure in which the swingable member 205 is provided only in one of the top and bottom portions of the first connector 202, or structure in which a pair of right and left swingable members 205 are disposed on both of the top and bottom portions of the first connector 202.

In the above-mentioned embodiment, the removal prevention portions 212 are respectively provided in the upper and lower horizontal plates 206 of the holder 201, and the projecting portions 217 corresponding to the securing stepped portions 212*b* of such removal prevention portions 212 are respectively provided in the connector housing 214 of the first connector 202. Due to this, by bringing the projecting portions 217 into contact with the securing stepped portions 212*b*, the holder 201 and first connector 202 can be kept in a stably connected condition.

And, as described before, the tapered surfaces 212*c* of the removal prevention portions 212 are respectively formed in the outer surfaces of the leading end portions of the securing stepped portions 212*b*, and the slits 212*a* are formed between the horizontal plates 206 of the holder 201 and the removal prevention portions 212. Thanks to this, when the embodiment is structured such that the projecting portions 217 can be pressed against the tapered surfaces 212*c* of the securing stepped portions 212*b* to thereby deform the removal prevention portions 212 elastically, the connecting operation of the first connector 202 to the holder 201 can be executed with one touch. Also, it is also possible that, as the need arises, by deforming the removal prevention portions 212 elastically, the first connector 202 within the holder 201 can be taken out externally of the holder 201.

Also, in the above-mentioned embodiment, the provisionally securing portions 218 are provided on the two right and left side surfaces of the connector housing 214 of the first connector 202 and, as shown in FIG. 13, by bringing the projecting portions 218*c* of the provisionally securing portions 218 into contact with the front surface of the holder 201, the first connector 202 can be secured at the connection wait position provisionally. Due to this structure, it is possible to effectively prevent the first connector 202 from being pushed into the holder 201 before execution of the above-mentioned connecting operation, by use of a simple structure.

And, when each of the above-mentioned provisionally securing portions 218 is composed of a base end portion 218*a* projectingly provided on the side wall surface of the connector housing 214, a plate-shaped portion 218*b* which is so formed as to extend forwardly while it is disposed opposed to the side wall surface of the connector housing 214 at a given distance therefrom, and a projecting portion 218*c* provided on the outer surface of the leading end portion of the plate-shaped portion 218*b*, a pair of tapered surfaces are formed in the outer side surface of the projecting portion 218*c*, and a projecting portion 219 including a pair of tapered surfaces respectively corresponding to the pair of tapered surfaces of the projecting portion 218*c* is provided on the front surface of the holder 201, if the two tapered surface of the projecting portion 218*c* are contacted with the two tapered surfaces of the projecting portion 219 to thereby deform the plate-shaped portion 218*b* elastically, then the provisionally secured condition of the-first connector 202 by the provisionally securing portion 218 can be removed easily with one touch.

According to the invention, however, instead of the above-mentioned provisionally securing portions 218, there may be provided energizing means which can energize the first connector 202 forwardly, and the projecting portions 216 of the connector housing 214 may be contacted with the securing stepped portions 212*b* of the removal prevention portions 212 according to the energizing force of the energizing means, so that the first connector 202 can be secured at the above-mentioned connection wait position.

Figure 18:
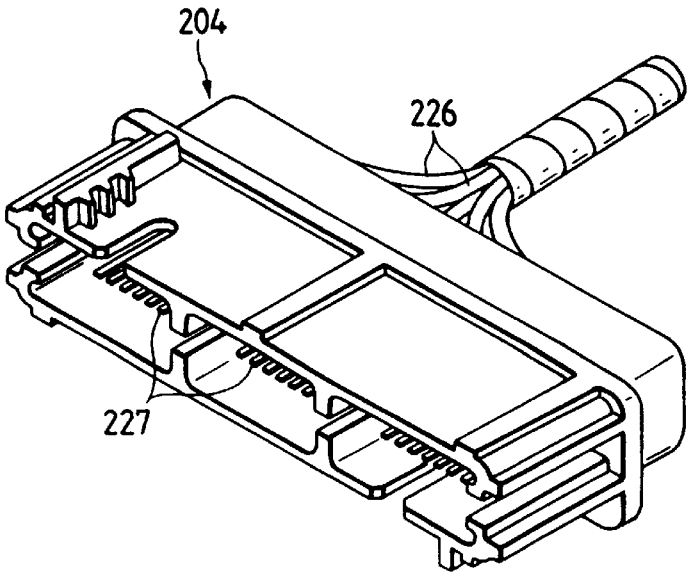
FIG. 18 is a perspective view of another embodiment of the second connector.

And, according to the invention, it is not always necessary that the second connector 204 to be connected to the first connector 202 is mounted on the circuit board 203 provided in the electronic unit 222 but, as shown in FIG. 18, a second connector 204 including a female-type connector housing 220 and a plurality of male-type terminals 227 with harnesses 226 connected to the rear end portions thereof may be directly connected to the first connector 202. Also, it is not always necessary that the holder 201 and first connector 202 are supported by the mounting portion S, but they may be structured such that an operator holds the holder 201 and first connector 202 and connects them directly to the second connector 204.

In the above-mentioned embodiment, description has been given of a case in which the first connector 202 supported slidably by the holder 201 is mounted on the mounting portion S provided on the vehicle body side, and the second connector 204 to be connected to the first connector 202 is mounted on the electronic unit 222. However, this is not limitative but, for example, the first connector 202 including the swingable members 205, male-type connector housing 214 and the like as well as the holder 201 may be installed on the electronic unit 222, and the second connector 204 including the female-type connector housing 220 and the like may be arranged on the mounting portion S. In this case, the electronic unit 222 serves as a mounting portion for mounting the first connector 202.

Also, instead of the above-mentioned structure in which the engaging pins 209 provided on the swingable members 205 are respectively introduced into and engaged with the guide grooves 210 formed in the holder 201, there can be employed a structure in which engaging pins 209 are provided on the holder 201 and guide grooves 210 to be engaged by the engaging pins 209 are formed in the swingable members 205. Further, it is also possible to employ a structure in which the swingable members 205 are swingably supported by the holder 201 and either the drive groove portions 210*b* of the guide grooves 210 forming the drive part for swinging and displacing the swingable members 205 or the engaging pins 209 are provided on the connector housing 214 of the first connector 202.

As has been described heretofore, according to the second aspect of the invention, the swingable member including a pinion portion in the leading end portion thereof is swingably supported between the holder and first connector, there are provided in the second connector the rack portions which can be meshingly engaged with the pinion portions of the swingable member, there is provided a drive part which, in the connecting operation to connect the second connector to the first connector, can swing and displace the swing member according to the sliding motion of the first connector to thereby drive the pinion portions in a direction where the second connector is moved toward the first connector, and the distance from the drive part to the swing support point of the swingable member is set larger than the distance from the pinion portions of the swingable member to the swingable support point of the swingable member. Thanks to this structure, a great connecting force can be applied to the connecting portions of the two connectors by a one-touch operation to connect the second connector to the first connector. Therefore, even when a connector of a multi-polar structure having a large connection resistance is disposed at a position into which an operator's hand cannot be inserted, the connecting operation of the two connectors can be carried out easily and positively and, at the same time, it is possible to prevent a dead space from being produced in the rear of the connector or in other similar portions thereof, thereby being able to control the size of the connector installation space down to a minimum.

Also, according to the invention, since the plate-shaped swingable members is interposed between the wall surface of the holder and the wall surface of the first connector opposed to the present holder wall surface, the size of the installation space, which is formed between the inner wall surface of the holder and the outer wall surface of the first connector for installation of the swingable member, can be reduced. This makes it possible not only to effectively prevent the connector increasing in the vertical dimension thereof but also to prevent the swingable member from projecting outwardly of the connector.

Further, according to the invention, because a pair of swingable members are disposed in the connecting portions of the first and second connectors as well as the two swingable members are arranged at point symmetrical positions to each other, a great connecting force can be applied from the swingable members to the two end portions of the two connectors on the diagonal lines thereof according as the first connector is slid according to the drive force for connecting the first and second connectors to each other, whereby the connecting force can be applied uniformly to the respective portions of the two connectors and thus the two connectors can be connected together properly by a simple structure. Also, since the two swingable members having the same shape can be disposed on the upper and lower portions of the connector, the productivity of the swingable members can be enhanced and thus the manufacturing costs thereof can be reduced.

Still further, according to the invention, due to the fact that the removal prevention portions for preventing the first connector held by the holder from pulled out of the holder are provided in the connecting portions of the holder and first connector, the connected condition between the holder and first connector can be maintained stably to, thereby effectively prevent the first connector from being removed from the holder.

Yet further, according to the invention, in the connecting portions of the holder and first connector, there are provided the provisionally securing portions for securing the first connector at the connection wait position provisionally, and the provisionally secured condition of the first connector by the provisionally securing portions can be removed according to an operation force for connecting the first and second connectors to each other. Due to this structure, it is possible to prevent the first connector from being pushed into the holder before execution of the connecting operation of the two connectors and, in the connecting operation of the two connectors, the provisionally secured condition of the first connector by the provisionally securing portions can be removed with one touch.

What is claimed is:

1. A connector connecting structure comprising:

a first connector;

a second connector connectable to said first connector;

a holder having a support portion that supports said first connector such that said first connector is slidable in a direction of connection of said second connector to said first connector;

at least one swingable member including a pinion portion in a leading end portion thereof and being disposed between said holder and said first connector, said at least one swingable member being swingable about a swingable support point provided on one of said holder and said first connector, a rack portion meshingly engageable with said pinion portion of said swingable member, said rack portion being formed in said second connector; and a drive part associated with said swingable member that swingingly displaces said swingable member in response to the sliding movement of said first connector during connection of said second connector to said first connector, to thereby drive said pinion portion in a direction where said second connector is moved toward said first connector;

wherein a distance from said drive part to the swingable support point of said swingable member is set larger than a distance from said pinion portion to said swingable support point of said swingable member.

2. A connector connecting structure as claimed in claim 1, wherein said at least one swingable member comprises a plate-shaped swingable member being interposed between an inner wall surface of said holder and an outer wall surface of said first connector that is opposed to said holder wall surface.

3. A connector connecting structure as claimed in claim 1, wherein said at least one swingable member comprises a pair of swingable members respectively installed along mutually opposed wall surfaces of said holder, and said two swingable members being arranged at positions symmetrical to each other with respect to a point.

4. A connector connecting structure as claimed in claim 1, wherein, in a connecting portion of said holder and first connector, there is provided a removal prevention portion which prevents said first connector from being pulled out forwardly from said holder.

5. A connector connecting structure as claimed in claim 1, further comprising a provisionally securing portion that provisionally secures said first connector at a connection wait position, said provisionally securing portion being formed at a connecting portion of said holder and said first connector, wherein the provisionally secured condition of said first connector by said provisionally securing portion can be removed according to an operation force that connects said first and second connectors to each other.

* * * * *